US007167566B1

(12) United States Patent
Bauck

(10) Patent No.: US 7,167,566 B1
(45) Date of Patent: Jan. 23, 2007

(54) TRANSAURAL STEREO DEVICE

(76) Inventor: Jerald L. Bauck, 7101 S. Heather Dr., Tempe, AZ (US) 85283

( * ) Notice: Subject to any disclaimer, the term of this patent is extended or adjusted under 35 U.S.C. 154(b) by 0 days.

(21) Appl. No.: 09/277,013

(22) Filed: Mar. 25, 1999

Related U.S. Application Data

(62) Division of application No. 08/716,587, filed on Sep. 18, 1996, now Pat. No. 5,889,867.

(51) Int. Cl.
*H04R 5/00* (2006.01)

(52) U.S. Cl. ..... 381/17

(58) Field of Classification Search ..... 381/1, 381/17, 18, 304

See application file for complete search history.

(56) References Cited

U.S. PATENT DOCUMENTS 4,349,698 A 9/1982 Iwahara
4,893,342 A 1/1990 Cooper et al.
4,910,779 A 3/1990 Cooper et al.
4,975,954 A 12/1990 Cooper et al.
5,034,983 A 7/1991 Cooper et al.
5,136,651 A 8/1992 Cooper et al.
5,333,200 A 7/1994 Cooper et al.

*Primary Examiner*—Ping Lee
(74) *Attorney, Agent, or Firm*—Welsh & Katz, Ltd.

(57) ABSTRACT

A method of creating an impression of sound from an imaginary source to a listener. The method includes the step of determining an acoustic matrix for an actual set of speakers at an actual location relative to the listener and the step of determining an acoustic matrix for transmission of an acoustic signal from an apparent speaker location different from the actual location to the listener. The method further includes the step of solving for a transfer function matrix to present the listener with an audio signal creating an audio image of sound emanating from the apparent speaker location.

6 Claims, 8 Drawing Sheets

Y
X
S2
S1
E2
E1
10
Yo
Xo
20
S2o
S4o
E2o
E1o
S1o
S3o
P4o
P3o
P2o
P1o

FIG. 9e
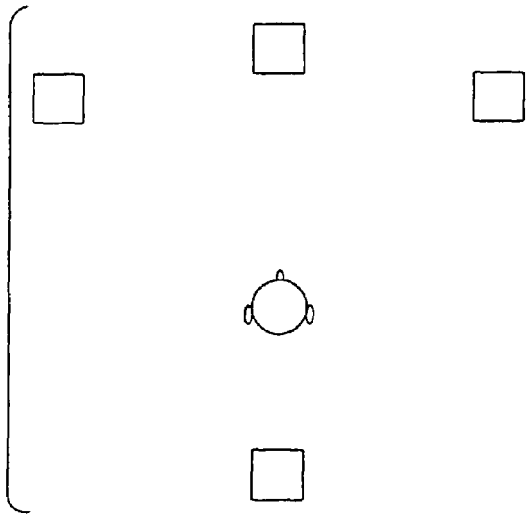
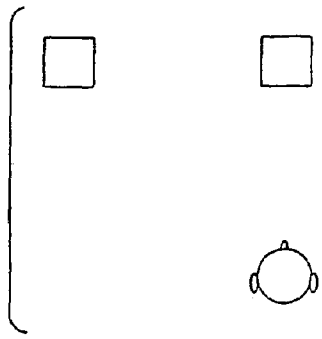
FIG. 9f
FIG. 9g
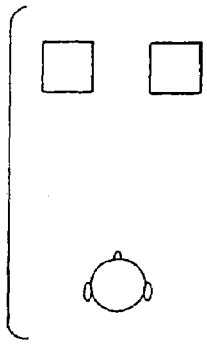
FIG. 9h
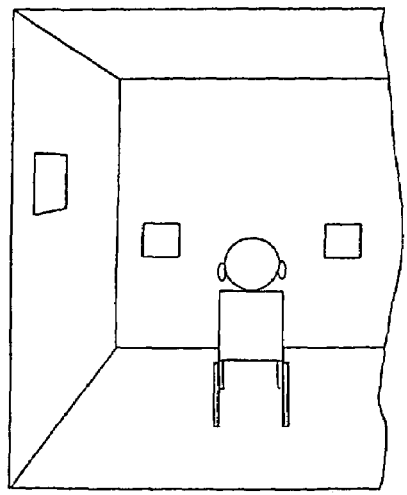

TRANSAURAL STEREO DEVICE

This is a Divisional Application of U.S. patent application Ser. No. 08/716,587, filed Sep. 18, 1996, now U.S. Pat. No. 5,889,867.

We herein develop a mathematical model of stereophony and stereo playback systems which is unconventional but completely general. The model, along with new combinations of components, may be used to facilitate an understanding of certain aspects of the invention.

FIG. 1 shows a generalized block diagram which may be used to depict generally any stereophonic playback system including any prior art stereo system and any embodiment of the present invention, for the purpose of providing a context for an understanding of the background of the invention and for the purpose of defining various symbols and mathematical conventions. It is understood that the figure depicts M loudspeakers $S_1 \ldots S_M$ playing signals $s_1 \ldots s_M$ and that there are L/2 people having L ears $E_1 \ldots E_L$ who are listening to the sounds made by the various loudspeakers. Acoustic signals $e_1 \ldots e_L$ are present at or near the ears or ear-drums of the listeners and result solely from sounds emanating from the various loudspeakers. The various signals herein are intended to be frequency-domain signals, which fact will be important for later mathematical and symbolic manipulations and discussions. Furthermore, various program signals $p_1 \ldots p_N$ are connected to a filter matrix Y by means of the various terminals $p_1 \ldots p_N$. FIG. 1, while suggesting some regularity, is not intended to imply any physical, spatial, or temporal constraints on the actual layout of the components.

As a common example from the prior art, let N=2=M, (i.e., ordinary stereo with two channels, commonly denoted Left and Right, with two loudspeakers, also commonly denoted Left and Right). Typically for this example, there is one listener (i.e., L=2) as well, although it is not uncommon for more than one person to listen to the stereo program.

Note also that the word "stereo" as used herein may differ somewhat from common usage, and is intended more in the spirit of its Greek roots, meaning "with depth" or even "three-dimensional". When used alone, we intend for it to mean nearly any combination of loudspeakers, listeners, recording techniques, layouts, etc.

As notated in FIG. 1, the symbols X, Y, and Z are mathematical matrices of transfer functions. Focusing-attention on X, a generic element of X is $X_{ij}$, which represents the transfer function to the i-th ear from the j-th loudspeaker. When necessary, these and other transfer functions may be determined, for example, by direct measurements on actual or dummy heads (any physical model of the head or approximation thereto, such as commercial acoustical mannequins, hat merchants' models, bowling balls, etc.), or by suitable mathematical or computer-based models which may be simplified as necessary to expedite implementation of the invention (finite element models, Lord Rayleigh's spherical diffraction calculation, stored databases of head-related transfer functions or interpolations thereof, spaced free-field points corresponding to ear locations, etc.). It will also be a usual practice to neglect nominal amounts of delay, as for example caused by the finite propagation speed of sound, in order to further simplify implementation—this is seen as a trivial step and will not be discussed further. The transfer functions herein may generally be defined or measured over all or part of the normal hearing range of human beings, or even beyond that range if it facilitates implementation or perceived performance, for example, the extra frequency range commonly needed for implementing antialiasing filters in digital audio equipment.

It is also to be understood that these transfer functions, which may be primarily head-related or may contain effects of surrounding objects in addition to head diffraction effects, may be modified according to the teachings of Cooper and Bauck (e.g., within U.S. Pat. Nos. 4,893,342, 4,910,779, 4,975,954, 5,034,983, 5,136,651 and 5,333,200) in that they may be smoothed or converted to minimum phase types, for example. It is also understood that the transfer functions may be left relatively unmodified in their initial representation, and that modifications may be made to the resulting filters (to be described below) in any of the manners mentioned above, that is, by smoothing, conversion to minimum phase, delaying impulse responses to allow for noncausal properties, and so on.

As an example of a calculation involving some of the transfer functions in X, we may compute the signal $e_1$ at ear $E_1$ due to all the signals from all the loudspeakers. Linear acoustics is assumed here, and so the principle of superposition applies. (We also assume that the loudspeakers are unity gain devices, for simplicity—if in practice this is a problem, then it is possible to include their response in the transfer functions.) Then the signal at $E_1$ is seen to be $$e_1=s_1X_{1,1}+s_2X_{1,2}+\ldots+s_MX_{1,M}$$

In this way, any ear signal can be computed (or conceived). Using conventional matrix notation, we define the signal vectors $$p=[p_1p_2\ldots p_N]^T$$

$$s=[s_1s_2\ldots s_M]^T$$

$$e=[e_1e_2\ldots e_L]^T$$

where the superscript T denotes matrix transposition, that is, these vectors are actually column vectors but are written in transpose to save space. (We also suppress the explicit notation for frequency dependence of the vector components, for simplicity.) With the usual mathematical convention that matrix multiplication means repeated additions, we can now compactly and conveniently write all of the ear signals at once as $$e=Xs$$

where X has the dimensions L×M.

The filter matrix Y is included so as to allow a general formulation of stereo signal theory. It is generally a multiple-input, multiple-output connection of frequency-dependent filters, although time-dependent circuitry is also possible. The mathematical incorporation of this filter matrix is accomplished in the same way that X was incorporated—the transfer function from the jth input to the ith output is the transfer function $Y_{ij}$. Y has dimensions M×N. Although the filter matrix Y is shown as a single block in FIG. 1, it will ordinarily be made up of many electrical or electronic components, or digital code of similar functionality, such that each of the outputs are connected, either directly or indirectly, through normal electronic filters, to any or all of the inputs. Such a filter matrix is frequently encountered in electronic systems and studies thereof (e.g., in multiple-input, multiple-output control systems). In any event, the signal at the first output terminal, $s_1$, for example, may be computed from knowledge of all of the input signals $p_1 \ldots p_N$ as $$s_1=p_1Y_{1,1}+p_2Y_{1,2}+\ldots+p_NY_{1,N}$$

and, just as for the acoustic matrix X, the ensemble of filter-matrix output signals may be found as $$s=Yp$$

While the general formulation being presented here allows for any or all of these transfer functions to be frequency dependent, they may in specific cases be constant (i.e., not dependent upon frequency) or even zero. In fact, the essence of prior art systems is that these transfer functions are constant gain factors or zero, and if they are frequency-dependent, it is for the relatively trivial purpose of providing timbral adjustments to the perceived sound. It is also a feature of prior-art systems that Y is a diagonal matrix, so that signal channels are not mixed together. It is an object of this invention to show how these transfer functions may be made more elaborate in order to provide specific kinds of phantom imaging and in this respect the invention is novel. It is a further object of this invention to show how such elaborations can be derived and implemented.

As a prior-art example of the matrix Y, if the diagram in FIG. 1 is used to represent a conventional two-channel, two-speaker playback system, and the program signals are assumed to be those available at the point of playback, e.g., as available at the output of a compact disk system (including amplification, as necessary), the Y matrix is in fact a 2×2 identity matrix—the inputs $p_1$ and $p_2$ (commonly called Left and Right) are connected to the compact disk signals (Left and Right), and in turn connected directly to the loudspeakers (Left and Right), that is $$Y = I = \begin{bmatrix} 1 & 0 \\ 0 & 1 \end{bmatrix}$$

so that $s_1=p_1$ and $S_2=p_2$, simply a straight-through connection for each. This is the essence of all prior-art playback. Even if the playback system is a current state-of-the-art cinema format using five channels for playback, the Y matrix is a 5×5 identity matrix.

One may begin to appreciate the power of this general formulation of stereo by incorporating, for example, the gain of the amplification chain in the Y matrix. If the total gain (e.g. voltage gain) in the stereo system's playback signal chain is 50, including amplifiers within the compact disk unit, the system preamplifier and amplifier, then one could express this in terms of Y as, $$Y = \begin{bmatrix} 50 & 0 \\ 0 & 50 \end{bmatrix}$$

Or, perhaps the listener has adjusted the tone controls on the system's preamplifier so that an increase in bass response is heard. As this is frequently implemented as a shelf-type filter with response $$\frac{s+b}{s+a},\ b > a$$

where here s is the complex-valued frequency-domain variable commonly understood by electrical engineers. In this instance, Y would be written as $$Y = \begin{bmatrix} \frac{s+b}{s+a} & 0 \\ 0 & \frac{s+b}{s+a} \end{bmatrix}$$

Another possibility for a prior-art system is where the listener has adjusted the channel balance controls on the preamplifier to correct for a mismatch in gains between the two channels or in a crude attempt to compensate for the well-known precedence, or Haas, effect. In this case, the Y matrix to represent this balance adjustment may be, for example, $$Y = \begin{bmatrix} 1-\alpha & 0 \\ 0 & \alpha \end{bmatrix}$$

wherein a value for α of ½ represents a "centered" balance, a value of α=0 and α=1 represent only one channel or the other playing, and other values represent different "in between" balance settings. (This description is representative but ignores the common use of so-called "sine-cosine" or "sine-squared cosine-squared" potentiometers in the balance control, a concept which is not essential for this presentation.) If this balance adjustment is made in order to correct for perceived unbalanced imaging, as due to off-center listening and the precedence effect, it is an example of a prior-art attempt, simple and largely ineffective, to modify the playback signal chain to compensate for a loudspeaker-listener layout which is different than was intended by the producer of the program material. We will have much more to say about this so-called layout reformatting, as it is an object of this invention to provide a much more effective way of accomplishing this and many other techniques of layout reformatting which have not yet been conceived.

In describing these prior-art systems, a Y matrix that has nonzero off-diagonal terms has not appeared herein. This is generally a restriction on prior-art systems and in that context is considered undesirable because such a circumstance results in degraded imaging. In fact, a mixing operation which is sometimes performed is to convert two ordinary stereo signals into a monophonic, or mono, signal. This operation can be represented by $$Y = \begin{bmatrix} 1 & 1 \\ 1 & 1 \end{bmatrix}$$

this operation indeed modifies the imaging substantially, since, as is commonly known, the result is a single image centered midway between the speakers, rather than the usual spread of images along the arc between the speakers. (This mixing function also imparts an undesirable timbral shift to the centered phantom image.) It is an aspect of the present invention to show how, generally, all of the Y matrix elements may be used to advantageously control spatial and/or timbral aspects of phantom imaging as perceived by a listener or listeners. In doing so, we will also show that these matrix entries will generally, according to the invention, be frequency dependent.

That the present formulation is indeed quite general can be appreciated even more if the Y matrix is allowed to include signal mixing and equalization operations further up the signal chain, right into the production equipment. For example, modern multitrack recordings are made using mixing consoles with many more than two inputs and/or tracks. For example, N=24, 48, and 72 are not uncommon. Even semiprofessional and hobby recording and mixing equipment has four or eight inputs and/or tracks. It might be convenient in some applications to consider this "production" matrix as separate from the "playback" matrix. Such a formulation is straightforward and limited mathematically by only the usual requirements of matrix conformability with respect to multiplication. In other words, this invention anticipates that a recording-playback signal chain could be represented by more than one Y matrix, conceptually, say $Y_{production}$ and $Y_{playback}$. Readers familiar with cascaded multi-input, multi-output systems will recognize that the cascade of systems is represented mathematically by a (properly-ordered) matrix product. Since $Y_{production}$ occurs first in the signal chain, and $Y_{playback}$ occurs last (for example), the net effect of the two matrices is the product $Y_{playback}Y_{production}$, and the product can be further represented by a single equivalent matrix, as in $Y=Y_{playback}Y_{production}$. So it is seen that the separation into separate matrices is rather arbitrary and for the convenience of a given application or description thereof. It is the intention of the invention to accommodate all such contingencies.

This matrix, or linear algebraic, formulation has the advantage that powerful tools of linear algebra which have been developed in other disciplines can be brought to bear on the new, or transaural, stereo designs. However, for explanatory purposes, we will show examples below of simple systems which are specified by using both the matrix-style mathematics and ordinary algebra.

Referring to the earlier expression describing the filter transfer function matrix, $$s=Yp$$

and the acoustic transfer function-matrix $$e=Xs$$

we can combine them by simple substitution as $$e=XYp.$$

By way of summarizing the development so far, this equation can be understood as follows: the vector of input, or program, signals, p, is first operated on by the filter matrix Y. The result of that operation (not shown explicitly here but shown earlier as the vector of loudspeaker signals s) is next operated on by the acoustic transfer function matrix, X, resulting in the vector of ear signals, e. Notice that while it is common for functional block diagrams to be drawn with signals mostly flowing from right to left (FIG. 1 is somewhat of an exception, with signals flowing downward), the proper ordering of the matrices in the above equation is from right to left in the sequencing of operations. This is simply a result of the rules of matrix multiplication.

It will be convenient, as well as conceptually important in the description of the invention that follows, to from time to time further combine the matrix product XY into a single matrix, Z=XY. This step may be formally omitted, in that a single composite signal transfer from terminals $P_1 \ldots P_N$ to ears $E_1 \ldots E_L$ may be defined simply as a "desired" goal of the system design, a goal to be specified by the designer. This too will be elaborated below.

Prior-art systems describable by the above matrix formulation as taught by Jerry Bauck and Duane H. Cooper fall into a class of devices known as generalized crosstalk cancellers. These devices are described in detail in U.S. Pat. No. 5,333,200 and in the paper "Generalized Transaural Stereo," preprint number 3401 of the Audio Engineering Society. While describable by the matrix method, these devices are distinctly different than the layout reformatters of the present invention in that they are simpler, with Y usually having the form $X^+$, a pseudoinverse form described below, and other forms as well. They are also different in that their purpose is to simply-cancel acoustic crosstalk, that is, to invert the matrix X.

To reiterate, the mathematical formulation so far is quite general and suffices to describe both prior-art systems and techniques used in developing the systems of the invention. A superficial statement of the differences between prior-art systems and systems of the invention would include the fact that in prior-art systems, Y has a very simple structure and usually has elements which are frequency independent, while Y matrices of various embodiments of the invention have a more fleshed-out structure and will usually have elements which are frequency dependent. A further delineation between prior-art systems and systems of the invention is that the reason that the invention uses a more fully functional Y is generally for controlling the ear signals of listeners in a desired, systematic way, and further that highly desirable ear signals are those which make the listeners perceive that there are sources of sound in places where there are no loudspeakers. While such phantom imaging has historically been a stated goal of prior-art systems as well, the goal has never been pursued with the rigor of the present invention, and consequently success in reaching that goal has been incomplete.

It is therefore an object of the invention that any realization of the reformatter Y matrix is anticipated to be within the scope of the invention described herein. This includes both factored and unfactored forms.

Of factored forms, any factorization as being within the scope of the methods provided herein is claimed, especially those which reduce implementation cost of a reformatter in terms of hardware or software codes and the expense associated therewith.

Of the factorizations which reduce costs there is of special interest those which result in an implementation of Y which has three matrices, the leading and trailing ones of which consist entirely or mostly of 1s, −1s and 0s, or constant multiples thereof, and the middle one of which has fewer elements than Y itself.

Factorizations which exhibit only some of the above properties are anticipated as being within the scope of the invention.

Factorizations involving more than three matrices are also anticipated.

SUMMARY

Briefly, according to an embodiment of the invention, a method is provided for creating a binaural impression of sound from an imaginary source to a listener. The method includes the step of determining an acoustic matrix for an actual set of speakers at actual locations relative to the listener and the step of determining an acoustic matrix for transmission of an acoustic signal from an apparent speaker or imaginary source location different from the actual locations to the listener. The method further includes the step of solving for transfer functions to present the listener with a binaural audio signal creating an audio image of sound emanating from the apparent speaker location.

The procedures described herein show how the filter matrix Y can be specified. Designers will from time to time wish to modify the frequency response uniformly across the various signal channels to effect desirable timbral changes or to remove undesirable timbral characteristics. Such modification, uniformly applied to all signal channels, can be done without materially affecting the imaging performance. It may also be implemented on a "phantom image" basis without affecting imaging performance. It is a feature of the invention that these equalizations (EQs) can be implemented either as separate filters or combined with some or all of the filters comprising Y into a single, composite, filter. Said combinations may involve the well-known property that given transfer functions $H_1$ and $H_2$, then other transfer functions may be obtained by connecting them in various fashions. For example, $H_3=H_1H_2$ (cascade connection), $H_4=H_1+H_2$ (parallel connection), and $H_5=H_1/(1+H_1H_2)$ (feedback connection).

The filters specified herein and comprising the elements of Y may from time to time be nonrealizable. For instance, a filter may be noncausal, being required to react to an input signal before the input signal is applied. This circumstance occurs in other engineering fields and is handled by implementing the problematic impulse response by delaying. it electronically so that it is substantially causal.

It is an object of the invention that such a modification is allowed.

BRIEF DESCRIPTION OF THE DRAWINGS

FIGS. 9*a*–9*h* depict potential applications for the reformatter of FIG. 1.

DETAILED DESCRIPTION OF THE INVENTION

Figure 1:
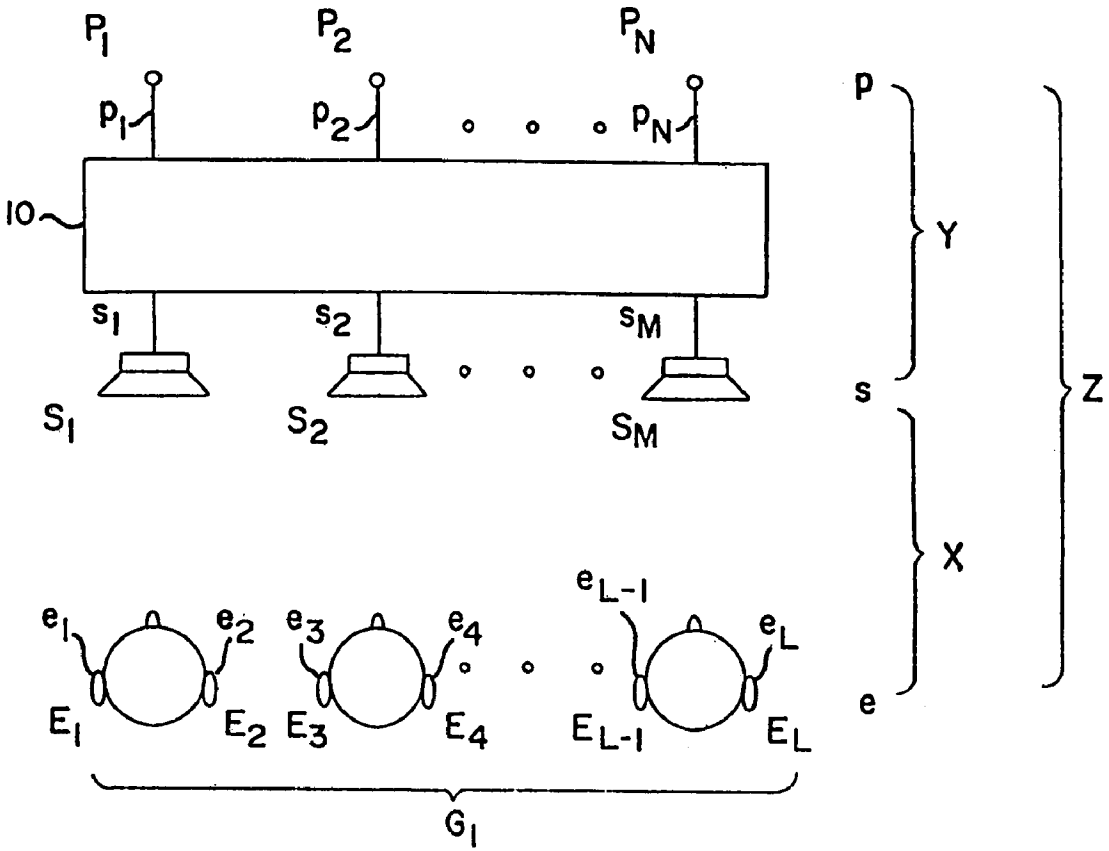
FIG. 1 is a block diagram of a general stereo playback system, including reformatter under an embodiment of the invention.

A standard technique of linear algebra, called the pseudoinverse, will now be described. While the properties and usefulness of the pseudoinverse solution are widely known, they will be summarized here as they apply to the invention, and for easy reference. Note that the particular presentation is in mathematical terms and the symbols do not directly relate to drawings herein.

In general, for the matrix expression Ax=b possibly of a sound distribution system as described herein, where A is an m×n matrix with complex entries, x is an n×1 complex-valued vector and b is an m×1 complex-valued vector (i.e., $A\epsilon C^{m\times n}$, $x\epsilon C^n$, $b\epsilon C^m$) an appropriate inner product may be defined by:

$$(x,y)=y^Hx,$$

where H indicates the conjugate (Hermitian) operation. The induced natural norm, the Euclidean norm, is $$|x|=(x,x)^{1/2}.$$

If b is not within the range space of A, then no solution exists for Ax=b, and an approximate solution is appropriate. However, there may be many solutions, in which case the minimum norm is of the most interest. Define a residual vector:

$$r(x)=Ax-b.$$

Then x is a solution to Ax=b if, and only if, r(x)=0. In some cases, an exact solution does not exist and a vector x which minimizes ||r(x)|| is the best alternative. This is generally referred to as the least-squares solution. However, there may be many vectors (e.g., zero or otherwise) which result in the same minimum value of ||r(x)||. In those cases, the unique x which is of minimum norm (and which minimizes ||r(x)||) is the best solution. The x which minimizes both the norms is referred to as the minimum-norm, least squares solution, or the minimum least squares solution.

All of the above contingencies are accommodated by the pseudoinverse, or Moore-Penrose inverse, denoted $A^+$. Using the pseudoinverse, the minimum-norm, least squares solution is written simply as $$x^o=A^+b.$$

When an exact solution is available, the pseudoinverse is the same as the usual inverse. It remains to be shown how the pseudoinverse can be determined.

Suppose A is an m×n matrix and rank(A)=m. Then the pseudoinverse is $$A^+=A^H(AA^H)^{-1}.$$

Note that if rank(A)=m, then the square matrix $AA^H$ is m×m and invertible. If m<n, then there are fewer equations than unknowns. In such a case, Ax=b is an underdetermined system, and at least one solution exists for all vectors b and the pseudoinverse gives the at least one norm.

Suppose again that A is an m×n matrix, but now rank(A) =n. In this case, the pseudoinverse is given by $$A^+=(A^HA)^{-1}A^H.$$

Since rank(A)=n, $A^HA$ is n×n and invertible. If m>n, the system is overdetermined and an exact solution does not exist. In this case, $A^+b$ minimizes ||r(x)||, and among all vectors which do so (if there are more than one), it is the one of minimum norm.

If rank(A)<min(m,n), then the calculation of the pseudoinverse is substantially complicated, since neither of the above matrix inverses exists. There are several routes that one could take. One route is to use a singular value decomposition (SVD), which is an extraordinarily useful tool, both as a numerical tool as well as a conceptual aid. It shall be described only briefly, as it is discussed in many books on linear algebra. Any m×n matrix A can be factored into the product of three matrices $$A=U\Sigma^+V^H$$

where U and V are unitary matrices, and Σ is a diagonal matrix with some of the entries on the diagonal being zero if A is rank-deficient. The columns of U, which is m×m, are the eigenvectors of $AA^H$. Similarly, the columns of V, which is n×n, are the eigenvectors of $A^HA$. If A has rank r, then r of the diagonal entries of Σ, which is n×n, are non-zero, and they are called the singular values of A. They are the square roots of the non-zero eigenvalues of both $A^HA$ and $AA^H$. Define $\Sigma^+$ as the matrix derived from Σ by replacing all of its non-zero entries by their reciprocals, and leaving the other entries zero. Then the pseudoinverse of A is $$A^+=V\Sigma^+U^H.$$

If A is invertible, then $A^+=A^{-1}$. If A is not rank-deficient, then this process yields an expression for the pseudoinverse discussed above.

Figure 2:
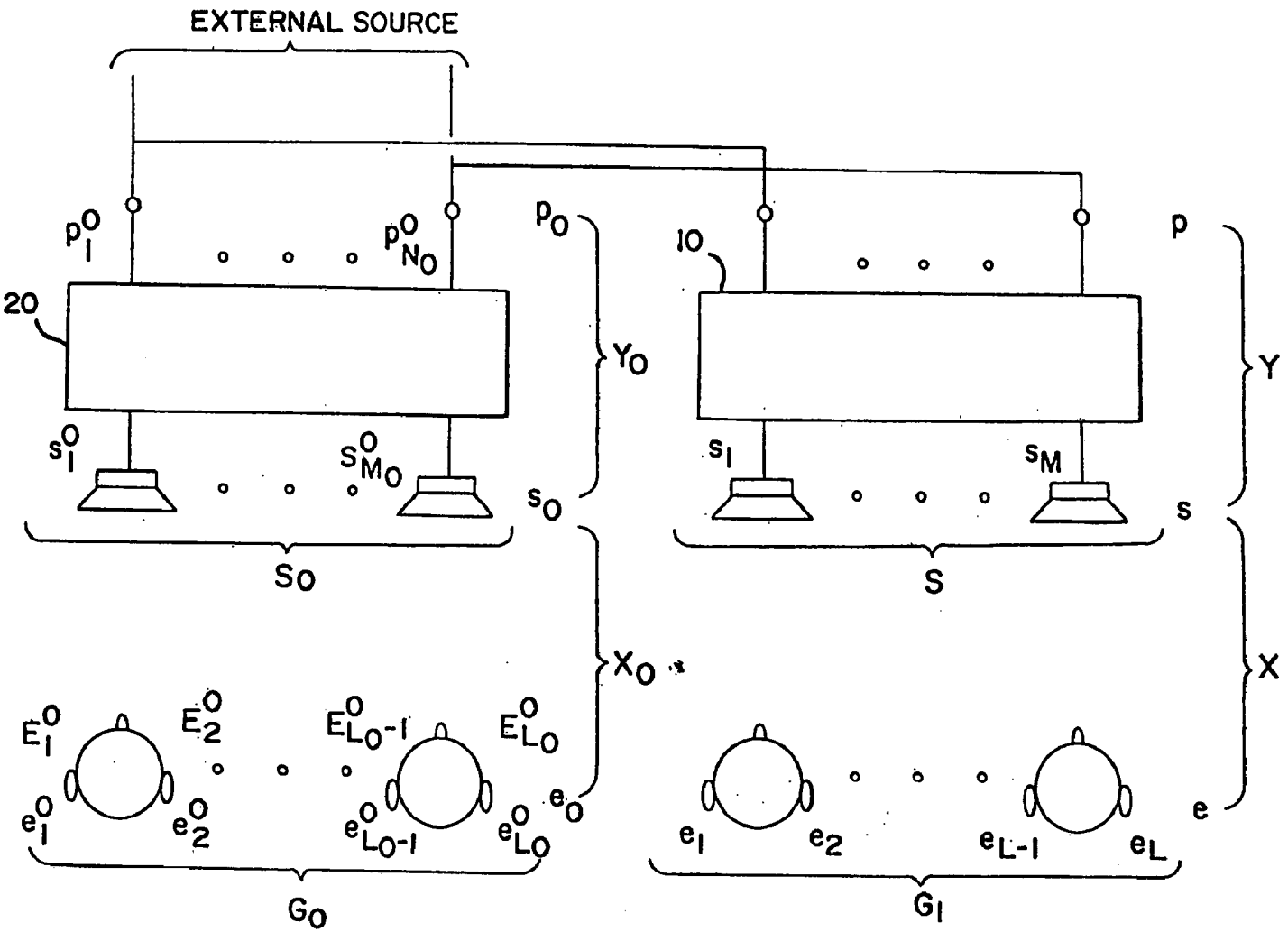
FIG. 2 depicts the reformatter of FIG. 1 in a context of use.

FIG. 2 shows the reformatter 10 in a context of use. As shown the reformatter 10 is shown conceptually in a parallel relationship with a prior art filter 20. Although 10 and 20 are shown connected, this is mainly to aid in an understanding of the presentation. A number of signals $p_1^0 \ldots p_{N0}^0$ are applied to the prior art multiple-input, multiple-output filter ($Y_0$) 20 which results in $L_0$ ear signals to the ears $e_1^0 \ldots e_{L0}^0$ of a group $G_0$ of $L_0$ listeners through an acoustic matrix $X_o$. In addition to 20 being a prior-art filter, it may also be a filter according to the invention, in which case a previously reformatted set of signals is now being converted to still another layout format. Acoustic matrix $X_0$ is a complex valued $L_0$ by $M_0$ vector having $L_0M_0$ elements including one element for each path between a speaker $S_j^0$ and an ear $E_i^0$ and having a value of $X_{ij}$.

The filter 20 may format the signals $p_1^0 \ldots p_{N0}^0$ to give a desired spatial impression to each of the listeners $G_0$ through the ears $e_1^0 \ldots e_{L0}^0$ For example, the filter 20 may format the signals $p_1^0 \ldots p_{N0}^0$ into a standard stereo signal for presentation to the ears $e_1^0$, $e_2^0$ of a listener $G_1$ through speakers $S_1$–$S_2$ arranged at ±30 degree angles on either side of the listener.

It is important to note, however, that none of the signals $e_1^0 \ldots e_{L0}^1$ need to be binaurally related in the sense that they derive from a dummy-head recording or simulation thereof. Also in many circumstances, the condition exists that $Y_0$=I, the identity matrix (i.e., the signals may be played directly through the speakers without an intervening filter network). Alternatively, the filter 20 may also be a cross-talk canceller where each signal $p_1$–$p_N$ may be entirely independent (e.g., voice signals of a group of translators simultaneously translating the same speech into a number of different languages) and each listener only hears the particular voice intended for its benefit, or it may be other prior-art systems such as those known as "quad" or "quadraphonic," or it may be a system such as ambisonics.

The need for a signal reformatter 10 becomes apparent when for any reason, X does not equal $X_0$. Such a situation may arise, for example, where the speakers $S_0$ and $S_1$ are different in number or are in different positions than intended, the listeners' ears are different in number or in different positions, or if the desired layout represented by 20 (or the components of the layout) changes. The latter could occur, for example, if a video game player is presented with six channels of sound around him or her, in theater style, and it is desired to rotate the entire "virtual theater" around the player interactively.

Another instance in which X does not equal $X_0$ is where one or both of these acoustic transfer function matrices includes some or all of the effects of the acoustical surroundings such as listening room response or diffraction from a computer monitor, and these effects differ from the desired layout ($X_0$) to the available layout (X). This instance includes the situation where the main acoustical elements (loudspeakers and heads) are in the same geometrical arrangements in their desired and available arrangements. For example, the desired layout may use a particular monitor, or no monitor, and the available layout has a particular monitor different from the desired monitor. Additionally, the main source of the difference may be merely in that the designer chose to include these effects in one space and not the other.

It is a feature of the invention that it may be used whenever X does not equal $X_0$ for any reason, including decisions by the designer to include acoustical effects of the two acoustical spaces in one or the other matrix, even though said effects may actually be identically present in both spaces.

It is a further feature of the invention to optionally include any and all acoustical effects due to the surroundings in defining the acoustic transfer function matrices X and $X_0$ and in subsequent calculations which use these matrices.

A layout reformatter will normally be needed when the available layout does not match the desired layout. A reformatter can be designed for a particular layout; then for some reason, the desired layout may change. Such a reason might be that a discrete multichannel sound system is being simulated during play (e.g., of a video game). During normal interactivity, the player may change his or her visual perspective of the game, and it may be desired to also change the aural perspective. This can be thought of as "rotating the virtual theater" around the player's head. Another reason may be that the player physically moves within his or her playback space, but it is desired to keep the aural perspective such that, from the player's perspective, the virtual theater remains fixed in space relative to a fixed reference in the room.

In the context of FIG. 2, the function of the reformatter 10 is to provide the listeners $G_1$ on the right side with the same ear signals as the listeners $G_0$ on the left side of FIG. 2, in spite of the fact that the acoustic matrix X is different than $X_0$. Furthermore, if there are not enough degrees of freedom to solve the problem of determining a transfer function Y for the reformatter 10, then the methodology of the pseudoinverse provides for determining an approximate solution. It is to be noted that not all listeners need to be present simultaneously, and that two listeners indicated schematically may in fact be one listener in two different positions; it is an object of the invention to accommodate that possibility. It has been determined that mutual coupling effects can be safely ignored in most situations or incorporated as part of the head related transfer function (HRTF) and/or room response.

The solution for the filter network 10 is straightforward. In structuring a solution, a number of assumptions may be made. First, the letter e will be assumed to be an L×1 vector representing the audio signals $e_1 \ldots e_L$ arriving at the ears of the listeners G from the reformatter 10. The letter s will be assumed to be an M×1 vector representing the speaker signals $s_1 \ldots s_M$ produced by the reformatter 10. Y is an M×N matrix for which $Y_{ij}$ is the transfer function of the reformatter from the jth input to the ith output of the reformatter 10.

Similarly, the letter $e_0$ is an $L_0$×1 vector representing the audio signals $e_1^0 \ldots e_{L0}^0$ received by the ears of the listeners $G_0$ from the filter 20 through the acoustic matrix $X_0$. The letter $s_0$ is an $M_0$×1 vector representing the speaker signals $s_1^0 \ldots s_{M0}^0$ produced by the filter 20. $Y_0$ is an $M_0 \times N_o$ matrix for which $Y_{ij}^0$ is the transfer from the jth input to the ith output of the filter 20.

From the left side of FIG. 2, the desired ear signals $e_0$ can be described in matrix notation by the expression:

$$e_0 = X_0 Y_0 p_0.$$

Where the terms $X_0$, $Y_0$ are grouped together into a single term ($Z_0$), the expression may be written in a simplified form as $$e_0 = Z_0 p_0.$$

Similarly, the ear signals e delivered to the listeners G through the reformatter 10 can be described by the expression:

$$e = XYp_0.$$

By requiring that the ear signals $e_0$ and e match (i.e., as close as possible in the least squares sense), it can be shown that a solution may be obtained as follows:

$$X_0 Y_0 = XY,$$

and a solution for Y is found as $$Y = X^+ X_0 Y_0.$$

If $M \geqq L$ (and there are no pathologies), then at least one solution exists, regardless of the size of M with respect to $M_0$. Obviously, each listener can receive the correct ear signals, but the entire sound field at non-ear points that would have existed using the filter 20 cannot be recreated-using the reformatter 10.

A series reformatter 30 (FIG. 3) is next considered. The underlying principle with the series formatter 30 (FIG. 3) is the same as with the parallel formatter 10 (FIG. 2), that is, the listeners G in the second space should hear the same sound with the same spatial impression as listeners $G_0$ in the first space but through a different acoustic matrix X. The acoustic signal in the ears $e_1^0 \ldots e_{L0}^0$ of the first set of listeners $G^0$ may be thought of as being formed either by simulating $X_0$ or by simulating both $X_0$ and $Y_0$, if necessary, or by actually making a recording using dummy heads. Again, for simplicity, the assumption can be made that L=K. Since the signal delivered to the first set of listeners $G_0$ is the same as the signal to the second set of listeners G an equation relating the transfer functions can be simply written as $$X_0 Y_0 = XYX_0 Y_0.$$

If $X_0 Y_0$ of the series formatter 10 is full rank, then its right-inverse exists, resulting in $$XY = I,$$

which has as a solution the expression $$Y = X^+.$$

Figure 3:
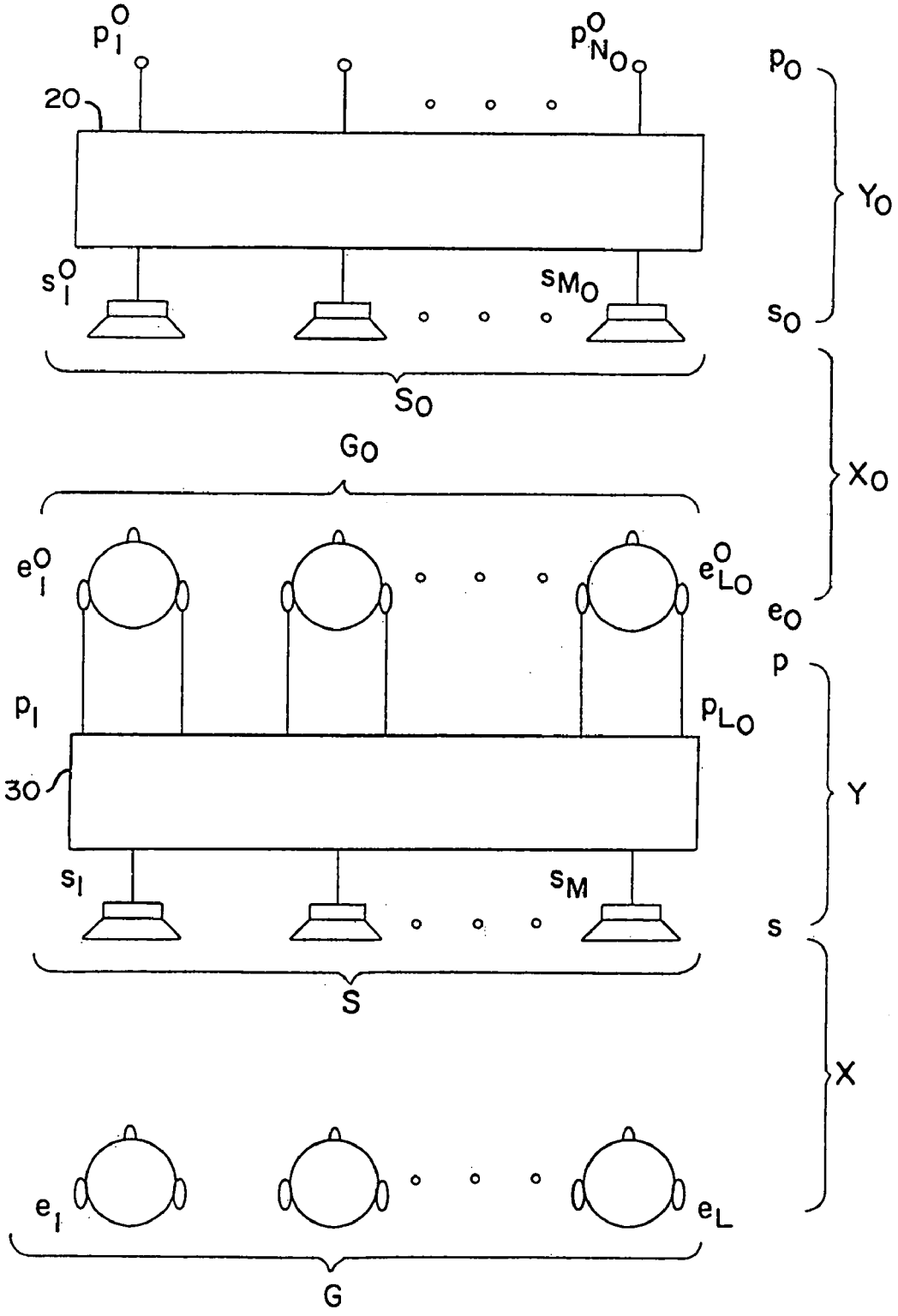
FIG. 3 depicts the reformatter of FIG. 1 in a context of use in an alternate embodiment.

This solution is that of a crosstalk canceller in which case, since $L = L_0$, then Z=I. This L is indicated by FIG. 3.

If $L \neq L_0$, then $Z \neq I$. However, Z can be derived from I by extending I by duplicating some of its rows (where $L > L_0$) or by deleting some of its rows (where $L < L_0$), in a manner which is analogous for both series and parallel layout reformatters.

It may also be noted at this point that the main difference between the two applications of layout reformatters (FIGS. 2 and 3) is that the parallel reformatter 10 of FIG. 2 has $p_0$ as its Y input, whereas the series type (FIG. 3) has $X_0 Y_0 p_0$ as its Y input.

Figure 4:
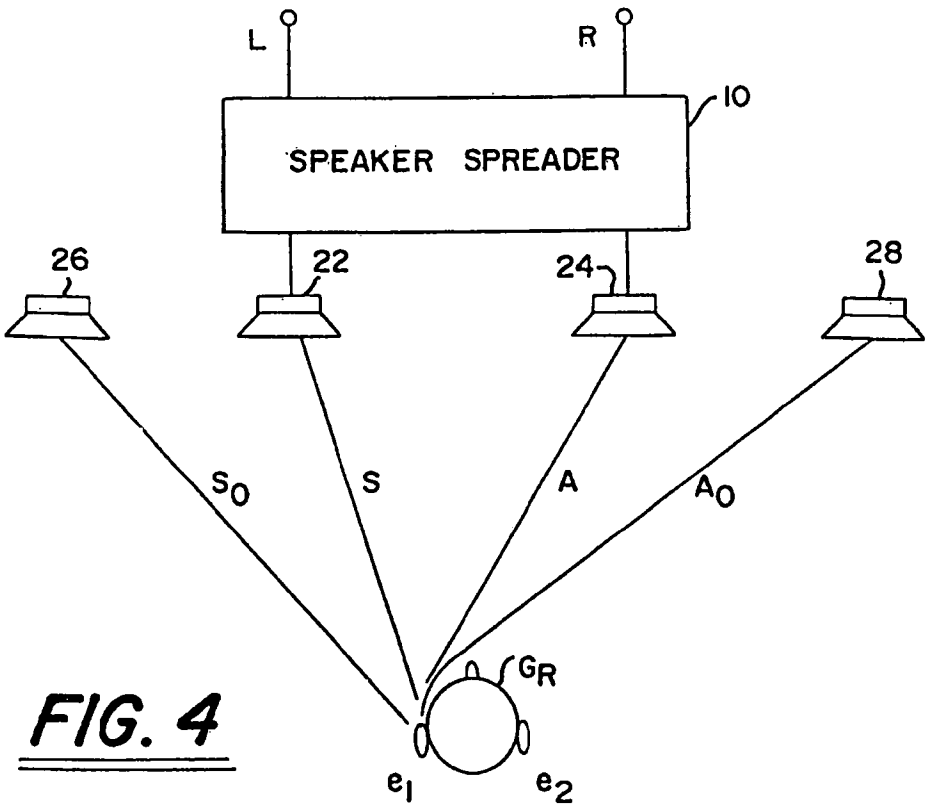
FIG. 4 depicts the reformatter of FIG. 1 in the context of use as a speaker spreader.

FIG. 4 is an example of a reformatter 10 used as a speaker spreader. Such a reformatter 10 may have application where stereo program materials were prepared for use with a set of speakers arrayed at a nominal ±30 degrees on either side of a listener and an actual set of speakers 22, 24 are at a much closer angle (e.g., ±10 degrees). The reformatter 10 in such a situation would be used to create the impression that the sound is coming from a set of speakers 26, 28. Such a situation may be encountered with cabinet-mounted speakers on stereo television sets, multimedia computers and portable stereo sets.

The reformatter 10 used as a speaker spreader in FIG. 4 is entirely consistent with the context of use shown in FIGS. 2 and 3. In FIG. 2, it may be assumed that the input stereo signal $p_0 \ldots p_1$ includes stereo formatting (e.g., for presentation from speakers placed at ±30 degrees to a listener), thus $Y_0 = I$.

As shown in FIG. 4, coefficient S (not to be confused with the collection of speakers S) represents an element of a symmetric acoustic matrix between a closest actual speaker 22 and the ear $E_1$ of the listener G. Coefficient A represents an element of an acoustic matrix between a next closest actual speaker 24 and the ear $E_1$ of the listener G. Coefficients S and A may be determined by actual sound measurements between the speakers 22, 24 or by simulation combining the effects of actual speaker placement and HRTF of the listener G.

Similarly $S_0$ and $A_0$ represent acoustic matrix elements between the imaginary speakers 26, 28 and the listener $G_0$. Coefficients $S_0$ and $A_0$ may also be determined by actual sound measurements between speakers actually placed in the locations shown or by simulation combining the imaginary speaker placement and HRTF of the listener $G_0$.

Figure 5:
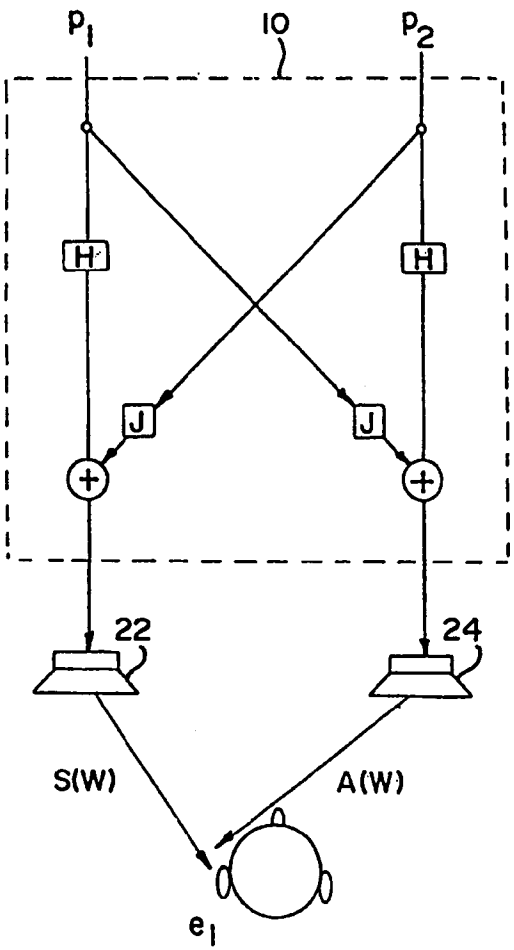
FIG. 5 depicts the reformatter of FIG. 1 constructed under a lattice filter format.

FIG. 5 is a simplified schematic of a lattice type reformatter 10 that may be used to provide the desired functionality of the speaker spreader of FIG. 4. To solve the equation for the transfer functions of a speaker spreader of the type desired, only one ear need be considered. It should be understood that while only one ear will be addressed, the answer is equally applicable to either ear because of the assumed symmetry.

By inspection, the acoustic matrix X of the diagram (FIG. 4) from the actual speakers 22, 24 to the ear $E_1$ of a listener $G_R$ may be written $$X = \begin{pmatrix} S & A \\ A & S \end{pmatrix}.$$

From FIG. 5, the transfer function Y of the reformatter 10 may be written in matrix form as $$Y = \begin{pmatrix} H & J \\ J & H \end{pmatrix}.$$

From FIG. 4, the overall transfer function Z, from the imaginary speakers 26, 28 may be written as $$Z = \begin{pmatrix} S_0 & A_0 \\ A_0 & S_0 \end{pmatrix}.$$

Substituting terms into the equation XY=Z results in the expression $$\begin{pmatrix} S & A \\ A & S \end{pmatrix} Y = \begin{pmatrix} S_0 & A_0 \\ A_0 & S_0 \end{pmatrix}.$$

Solving for reformatter Y results in the expression $$Y = \begin{pmatrix} S & A \\ A & S \end{pmatrix}^{-1} \begin{pmatrix} S_0 & A_0 \\ A_0 & S_0 \end{pmatrix},$$

which may be expanded to produce $$Y = \frac{1}{-A^2 + S^2} \begin{pmatrix} S & -A \\ -A & S \end{pmatrix} \begin{pmatrix} S_0 & A_0 \\ A_0 & S_0 \end{pmatrix}.$$

Using matrix multiplication, the expression may be further expanded to produce $$Y = \frac{1}{-A^2 + S^2} \begin{pmatrix} -AA_0 + SS_0 & -AS_0 + A_0S \\ -AS_0 + A_0S & -AA_0 + SS_0 \end{pmatrix}, \text{ and}$$

$$Y = \begin{pmatrix} \frac{SS_0 - AA_0}{S^2 - A^2} & \frac{A_0S - AS_0}{S^2 - A^2} \\ \frac{A_0S - AS_0}{S_2 - A^2} & \frac{SS_0 - AA_0}{S^2 - A^2} \end{pmatrix},$$

from which the values of H and J may be written explicitly as:

$$H = \frac{SS_0 - AA_0}{S^2 - A^2} \text{ and } J = \frac{SA_0 - AS_0}{S^2 - A^2}.$$

The above solution may be verified using ordinary algebra. By inspection, the same-side transfer function $S_0$ from the imaginary speaker 26 to the closest ear $E_1$ may be written as $S_0$=HS+JA. The alternate-side transfer function $A_0$ may be written as $A_0$=HA+JS. Solving for H in the expression for $S_0$ produces the expression $$H = \frac{S_0 - AJ}{S},$$

which may then be substituted into $A_0$ to produce $$A_0 = \frac{(S_0 - AJ)A}{S} + JS.$$

Expanding the result produces the expression $$A_0 = \frac{(S_0 - AJ)A + JS^2}{S},$$

which may then be factored and further simplified into $$A_0 = \frac{AS_0 + (-A^2 + S^2)J}{S}.$$

J may be derived from the expression to produce a result as shown $$J = \frac{SA_0 - AS_0}{S^2 - A^2}.$$

Substituting J back into the previous expression for H results in $$H = \frac{S_0 - \frac{(-AS_0 + A_0S)A}{-A^2 + S^2}}{S}$$

which may be expanded and further simplified to $$H = \frac{S_0S^2 - AA_0S}{(-A^2 + S^2)S}.$$

Factoring the results produces $$H = \frac{(-AA_0 + SS_0)S}{(-A^2 + S^2)S},$$

from which S may be canceled to produce $$H = \frac{-AA_0 + SS_0}{-A^2 + S^2} \text{ and } H = \frac{SS_0 - AA_0}{S^2 - A^2}.$$

A quick comparison reveals that the results using simple algebra are identical to the results obtained using the matrix analysis. It should also be apparent that the results for a similar calculation involving the right ear $E_2$ would be identical.

Figure 6:
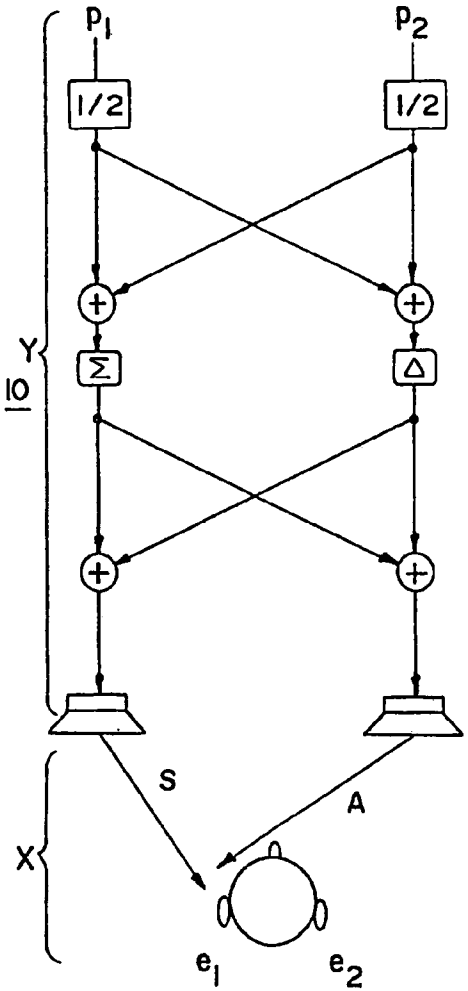
FIG. 6 depicts the reformatter of FIG. 1 constructed under a shuffler filter format.

Reference will now be made to FIG. 6 which is a specific type of speaker spreader (reformatter 10) referred to as a shuffler. It will now be demonstrated that the shuffler form of reformatter 10 of FIG. 6 is mathematically equivalent to the lattice type of reformatter 10 shown in FIG. 5.

The transfer function for the symmetric lattice of FIG. 5 is $$Y=\begin{pmatrix} H & J \\ J & H \end{pmatrix}.$$

It is a well known result of linear algebra that matrices can frequently be factored into a product of three matrices the middle of which is a diagonal matrix (i.e., off-diagonal elements are all zero). The general method for doing this involves computing the eigenvalues and eigenvectors.

It should be noted, however, that in some transaural applications, the leading and trailing matrices of the factor which are produced under an eigenvector analysis are frequency dependent. Frequency dependent elements are undesirable because these matrices would require filters to implement, which is costly. In those instances, other methods are used to factor the matrices. (The reader should note that there are several ways that a matrix may be factored, which are well known in the art.)

For the 2 by 2 symmetric case of a reformatter 10 with identical entries along the diagonal, the eigenvector method of analysis does, in fact, always produce frequency independent leading and trailing matrices. The form of the leading and trailing matrices is entirely consistent with the shuffler format.

We will assume that the factored form of Y has a form as follows $$\frac{1}{2}\begin{pmatrix} 1 & 1 \\ 1 & -1 \end{pmatrix}\begin{pmatrix} H+J & 0 \\ 0 & H-J \end{pmatrix}\begin{pmatrix} 1 & 1 \\ 1 & -1 \end{pmatrix}.$$

To show that this is the same as the Y for the lattice form, simply multiply the factors. Multiplying the middle diagonal matrix by the right matrix produces $$\frac{1}{2}\begin{pmatrix} 1 & 1 \\ 1 & -1 \end{pmatrix}\begin{pmatrix} H+J & 0 \\ 0 & H-J \end{pmatrix}\begin{pmatrix} 1 & 1 \\ 1 & -1 \end{pmatrix}=\frac{1}{2}\begin{pmatrix} 1 & 1 \\ 1 & -1 \end{pmatrix}\begin{pmatrix} H+J & H+J \\ H-J & -H+J \end{pmatrix}.$$

Multiplying by the left matrix produces $$\frac{1}{2}\begin{pmatrix} 1 & 1 \\ 1 & -1 \end{pmatrix}\begin{pmatrix} H+J & 0 \\ 0 & H-J \end{pmatrix}\begin{pmatrix} 1 & 1 \\ 1 & -1 \end{pmatrix}=\frac{1}{2}\begin{pmatrix} 2H & 2J \\ 2J & 2H \end{pmatrix}.$$

Dividing by 2 produces a final result as shown $$\frac{1}{2}\begin{pmatrix} 1 & 1 \\ 1 & -1 \end{pmatrix}\begin{pmatrix} H+j & 0 \\ 0 & H-j \end{pmatrix}\begin{pmatrix} 1 & 1 \\ 1 & -1 \end{pmatrix}=\frac{1}{2}\begin{pmatrix} 2H & 2J \\ 2J & 2H \end{pmatrix}.$$

Since the results are the same, it is clear that the lattice form and shuffler form are mathematically equivalent. The factored form takes only two filters, H+J and H−J. The lattice form takes four filters, two each of H and J.

To further demonstrate the equivalence of the lattice and shuffler forms of reformatters 10, an analysis may be provided to demonstrate that the shuffler factored form may be directly converted into the lattice form. Under the shuffler format, the notation of Σ and Δ are normally used for the "sum" and "difference" terms of the diagonal part of the factored form. Here Σ and Δ can be defined as follows:

$$\Sigma=H+J$$

and $$\Delta=H-J.$$

Substituting Σ and Δ into the previous equation results in a first expression $$\frac{1}{2}\begin{pmatrix} 1 & 1 \\ 1 & -1 \end{pmatrix}\begin{pmatrix} \sum & 0 \\ 0 & \Delta \end{pmatrix}\begin{pmatrix} 1 & 1 \\ 1 & -1 \end{pmatrix}=\begin{pmatrix} H & J \\ H & J \end{pmatrix},$$

which may be simplified to $$\begin{pmatrix} \sum & 0 \\ 0 & \Delta \end{pmatrix}=\left(\frac{1}{2}\begin{bmatrix} 1 & 1 \\ 1 & -1 \end{bmatrix}\right)^{-1}\begin{pmatrix} H & J \\ J & H \end{pmatrix}\begin{pmatrix} 1 & 1 \\ 1 & -1 \end{pmatrix}^{-1} \text{ and}$$

$$\begin{pmatrix} \sum & 0 \\ 0 & \Delta \end{pmatrix}=-\begin{pmatrix} 1 & 1 \\ 1 & -1 \end{pmatrix}^{-1}\begin{pmatrix} H & J \\ J & H \end{pmatrix}\begin{pmatrix} 1 & 1 \\ 1 & -1 \end{pmatrix}^{-1}.$$

Simplifying by multiplying the right-most matrices produces the result as follows $$\begin{pmatrix} \sum & 0 \\ 0 & \Delta \end{pmatrix}=\frac{1}{2}\begin{pmatrix} -1 & -1 \\ -1 & 1 \end{pmatrix}\begin{pmatrix} -H-J & -H+J \\ -H-J & H-J \end{pmatrix},$$

which may be further simplified through multiplication to produce $$\begin{pmatrix} \sum & 0 \\ 0 & \Delta \end{pmatrix}=\begin{pmatrix} H+J & 0 \\ 0 & H-J \end{pmatrix}.$$

We can also solve for the lattice terms explicitly by expanding the left side of the first expression to produce $$\frac{1}{2}\begin{pmatrix} 1 & 1 \\ 1 & -1 \end{pmatrix}\begin{pmatrix} \sum & \sum \\ \Delta & -\Delta \end{pmatrix}=\begin{pmatrix} H & J \\ J & H \end{pmatrix},$$

which can be further simplified to produce $$\frac{1}{2}\begin{pmatrix} \sum+\Delta & \sum-\Delta \\ \sum-\Delta & \sum+\Delta \end{pmatrix}=\begin{pmatrix} H & J \\ J & H \end{pmatrix} \text{ and}$$

-continued $$\begin{pmatrix} \frac{1}{2}[\sum+\Delta] & \frac{1}{2}[\sum-\Delta] \\ \frac{1}{2}[\sum-\Delta] & \frac{1}{2}[\sum+\Delta] \end{pmatrix} = \begin{pmatrix} H & J \\ J & H \end{pmatrix}.$$

From the last expression we see that $H=\frac{1}{2}(\Sigma+\Delta)$ and $J=\frac{1}{2}(\Sigma-\Delta)$.

With these results, it becomes simple to convert from the lattice form to the shuffler form and from the shuffler-form to the lattice form.

As a next step the coefficients of the reformatter 10 will be derived directly under the shuffler format. As above the values of X, Y and Z may be determined by inspection and may be written as follows:

$$X = \begin{pmatrix} S & A \\ A & S \end{pmatrix}, Y = \frac{1}{2}\begin{pmatrix} 1 & 1 \\ 1 & -1 \end{pmatrix}\begin{pmatrix} \sum & 0 \\ 0 & \Delta \end{pmatrix}\begin{pmatrix} 1 & 1 \\ 1 & -1 \end{pmatrix} \text{ and}$$

$$Z = \begin{pmatrix} S_0 & A_0 \\ A_0 & S_0 \end{pmatrix}.$$

Putting the elements into the form XY=Z produces $$\frac{1}{2}\begin{pmatrix} S & A \\ A & S \end{pmatrix}\begin{pmatrix} 1 & 1 \\ 1 & -1 \end{pmatrix}\begin{pmatrix} \sum & 0 \\ 0 & \Delta \end{pmatrix}\begin{pmatrix} 1 & 1 \\ 1 & -1 \end{pmatrix} = \begin{pmatrix} S_0 & A_0 \\ A_0 & S_0 \end{pmatrix},$$

which may be rewritten and further simplified to $$\begin{pmatrix} S & A \\ A & S \end{pmatrix}\begin{pmatrix} 1 & 1 \\ 1 & -1 \end{pmatrix}\begin{pmatrix} \sum & 0 \\ 0 & \Delta \end{pmatrix}\begin{pmatrix} 1 & 1 \\ 1 & -1 \end{pmatrix} = \begin{pmatrix} S_0 & A_0 \\ A_0 & S_0 \end{pmatrix},$$

By multiplying matrices the equality may be reduced to $$\begin{pmatrix} S & A \\ A & S \end{pmatrix}\begin{pmatrix} 1 & 1 \\ 1 & -1 \end{pmatrix}\begin{pmatrix} \sum & 0 \\ 0 & \Delta \end{pmatrix} = \begin{pmatrix} A_0+S_0 & -A_0+S_0 \\ A_0+S_0 & A_0-S_0 \end{pmatrix} \text{ and}$$

$$\begin{pmatrix} A+S & -A+S \\ A+S & A-S \end{pmatrix}\begin{pmatrix} \sum & 0 \\ 0 & \Delta \end{pmatrix} = \begin{pmatrix} A_0+S_0 & -A_0+S_0 \\ A_0+S_0 & A_0-S_0 \end{pmatrix}.$$

Rewriting produces a further simplification of $$\begin{pmatrix} \sum & 0 \\ 0 & \Delta \end{pmatrix} = \begin{pmatrix} A+S & -A+S \\ A+S & A-S \end{pmatrix}^{-1}\begin{pmatrix} A_0+S_0 & -A_0+S_0 \\ A_0+S_0 & A_0-S_0 \end{pmatrix}$$

which through matrix multiplication produces $$\begin{pmatrix} \sum & 0 \\ 0 & \Delta \end{pmatrix} =$$

$$\frac{1}{[A+S][A-S]-[A+S][-A+S]}\begin{bmatrix} A-S & A-S \\ -A-S & A+S \end{bmatrix}\begin{pmatrix} A_0+S_0 & -A_0+S_0 \\ A_0+S_0 & A_0-S_0 \end{pmatrix}$$

Simplifying the result produces $$\begin{pmatrix} \sum & 0 \\ 0 & \Delta \end{pmatrix} = \frac{1}{2}\frac{1}{A^2-S^2}\begin{pmatrix} A-S & A-S \\ -A-S & A+S \end{pmatrix}\begin{pmatrix} A_0+S_0 & -A_0+S_0 \\ A_0+S_0 & A_0-S_0 \end{pmatrix} \text{ and}$$

$$\begin{pmatrix} \sum & 0 \\ 0 & \Delta \end{pmatrix} = \frac{1}{2}\frac{1}{A^2-S^2}\begin{pmatrix} 2[A-S][A_0+S_0] & [A-S][A_0-S_0]+[A-S][-A_0+S_0] \\ [A+S][A_0+S_0]+[-A-S][A_0+S_0] & [A+S][A_0-S_0]+[-A-S][-A_0+S_0] \end{pmatrix}. \text{ and}$$

$$\begin{pmatrix} \sum & 0 \\ 0 & \Delta \end{pmatrix} = \frac{1}{2}\frac{1}{A^2-S^2}\begin{pmatrix} 2AA_0+2AS_0-2SS_0-2A_0S & 0 \\ 0 & 2AA_0-2AS_0-2SS_0+2A_0S \end{pmatrix}.$$

Notice how the off-diagonal terms on the right-hand side of the expression have become zero without any-additional effort. This is because of the geometric symmetry in the speaker-listener layout, which is reflected in the symmetry of the matrices with which we are dealing.

Continuing, the equality may be factored into $$\begin{pmatrix} \Sigma & 0 \\ 0 & \Delta \end{pmatrix} = \frac{1}{2}\frac{1}{(A+S)(A-S)}\begin{pmatrix} 2[A-S][A_0+S_0] & 0 \\ 0 & 2[A+S][A_0-S_0] \end{pmatrix}$$

which may be expanded into $$\begin{pmatrix} \Sigma & 0 \\ 0 & \Delta \end{pmatrix} = \begin{pmatrix} \frac{S_0 + A_0}{S + A} & 0 \\ 0 & \frac{S_0 - A_0}{S - A} \end{pmatrix}.$$

The result of the matrix analysis for the shuffler form of the reformatter 10 may be further verified using an algebraic analysis. From FIG. 6 we can equate the desired transfer functions from each input $p_1$, $p_2$ to each ear of the listener via the imaginary speakers 26, 28, to the available transfer functions from $p_1$, $p_2$, through 10, through the actual speakers 22, 24, and terminating once again at the ears of the listener. The desired transfer functions $S_0$ and $A_0$ can be written $$S_0 = \frac{1}{2}(\Sigma S + \Delta S + \Sigma A - \Delta A) \text{ and}$$

$$A_0 = \frac{1}{2}(\Sigma S - \Delta S + \Sigma A + \Delta A).$$

Note that these two equations may be factored in two-different ways one way, producing a first result, is $$S_0 = \frac{1}{2}([A + S]\Sigma + [S - A]\Delta) \text{ and}$$

$$A_0 = \frac{1}{2}([A + S]\Sigma + [A - S]\Delta).$$

A second way producing a second result is $$S_0 = \frac{1}{2}([\Sigma + \Delta]S + [\Sigma - \Delta]A) \text{ and}$$

$$A_0 = \frac{1}{2}([\Sigma - \Delta]S + [\Sigma + \Delta]A).$$

Solving for the coefficient Σ, from the first factored result for $S_0$ produces $$\Sigma = \frac{2S_0 - (-A + S)\Delta}{A + S}.$$

Substituting Σ back into the first factored result for Δ and solving produces $$A_0 = \frac{1}{2}(2S_0 + [A - S]\Delta - [-A + S]\Delta),$$

which may be simplified to $$A_0 = \frac{1}{2}(2S_0 + 2A\Delta - 2\Delta S).$$

This expression may be rearranged and factored into $$A_0 = \frac{1}{2}(2S_0 + 2[A - S]\Delta)$$

and solved to produce $$\Delta = \frac{1}{2}\frac{2A_0 - 2S_0}{A - S} \text{ and}$$

$$\Delta = \frac{S_0 - A_0}{S - A}.$$

Substituting Δ back into the expression for Σ produces the expression $$\Sigma = \frac{S_0 - A_0}{S + A}.$$

Figure 7:
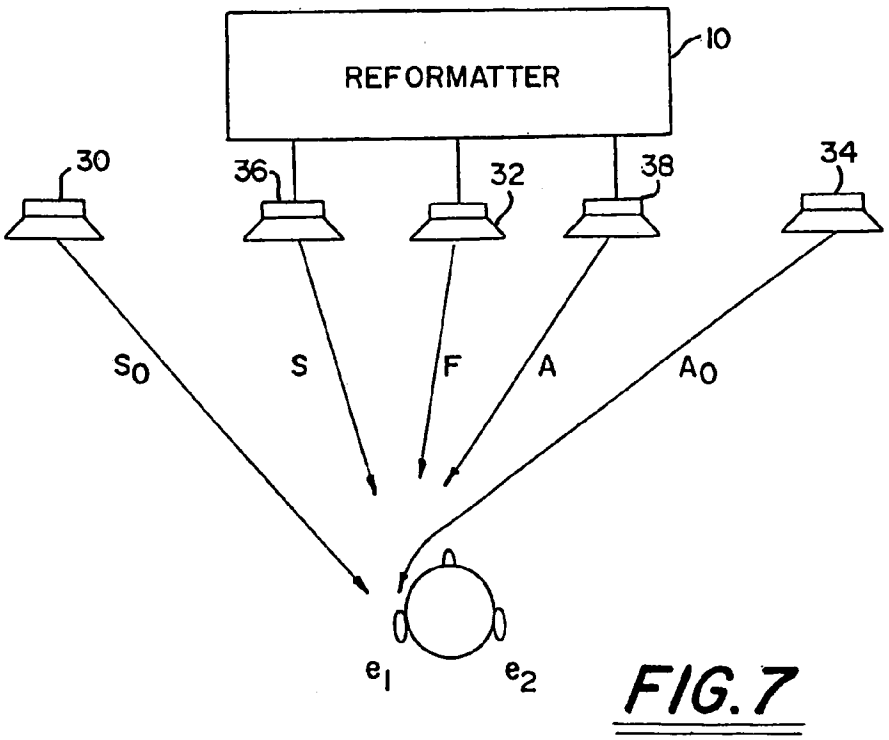
FIG. 7 depicts a reformatter of FIG. 1 constructed to simulate a third speaker in a stereo system.

As a further example (FIG. 7), a third speaker 32 is added to a standard two speaker layout for purposes of stabilizing the center image. The intent is to enable a listener to hear the same ear signals with the three-speaker layout as he or she would with the two-speaker layout and to enable off-center listeners to hear a completely stable center image along with improved placement of other images.

It will be assumed that the side speakers 36, 38 receive only filtered L+R and L−R signals. It is also not necessary that $S_0$=S or $A_0$=A, in that the reformatter 10 of FIG. 7 could just as well create the impression of imaginary speakers 30, 34 from the actual speakers 36, 38. As before, solve $XY=X_0Y_0$ for Y, but now with $Y_0$=I, $$X_0 = \begin{bmatrix} S_0 & A_0 \\ A_0 & S_0 \end{bmatrix} \text{ and}$$

$$X = \begin{bmatrix} S & F & A \\ A & F & S \end{bmatrix}$$

If it is assumed that a shuffler would be the most appropriate, then a shuffler "prefactoring" Y may be written as $$Y = \begin{pmatrix} 0 & 1 \\ 1 & 0 \\ 0 & -1 \end{pmatrix} \begin{pmatrix} \Sigma & 0 \\ 0 & \Delta \end{pmatrix} \begin{pmatrix} 1 & 1 \\ 1 & -1 \end{pmatrix}.$$

Following steps similar to those demonstrated in detail above produces a result as follows $$\begin{pmatrix} \Sigma & 0 \\ 0 & \Delta \end{pmatrix} = \begin{pmatrix} \frac{1}{2}\frac{S_0 + A_0}{F} & 0 \\ 0 & \frac{1}{2}\frac{S_0 - A_0}{S - A} \end{pmatrix}.$$

If the assumption is now made that $S_0$=S, and $A_0$=A, that is to say, that only the center speaker 32 is to be added by the reformatter 10 without creating phantom side speakers, then we obtain the particularly simple reformatter 10 as follows:

$$\begin{pmatrix} \Sigma & 0 \\ 0 & \Delta \end{pmatrix} = \begin{pmatrix} \frac{1}{2}\frac{S+A}{F} & 0 \\ 0 & \frac{1}{2} \end{pmatrix}.$$

Figure 8:
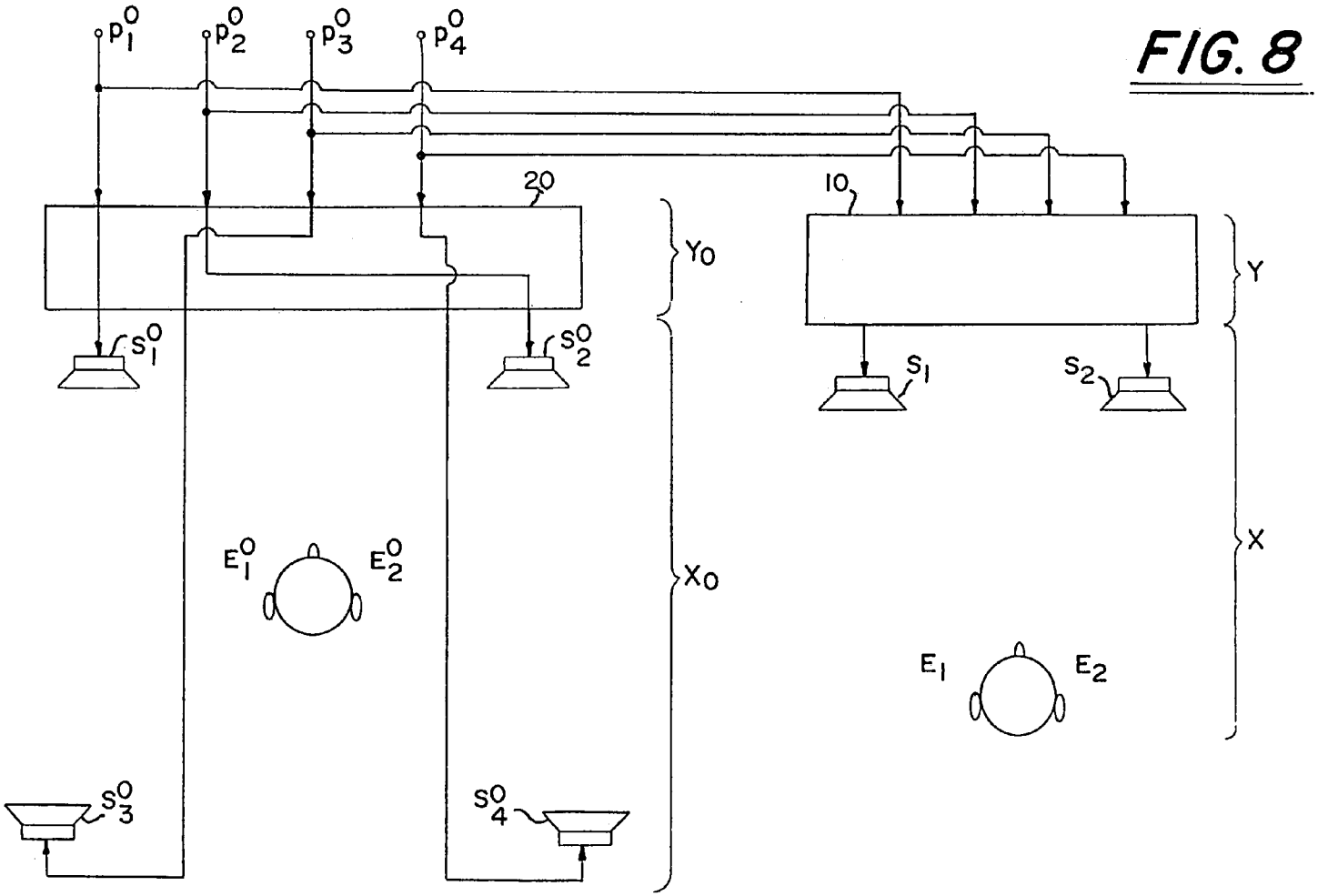
FIG. 8 depicts the reformatter of FIG. 1 in the context of a simulated virtual surround system.

In another embodiment, an example is provided of a layout reformatter which reformats four signals, $N_0=4$, which are intended to be played over four loudspeakers $S_0$, $M_0=4$, to a single listener, $L_0=4$. However, the available layout (FIG. 8) is different, with only M=2 loudspeakers S available. For the purpose of this example, let the intended positions of the four loudspeakers S be at ±45° and ±135°, where the reference angle, 0°, is directly in front of the listener. For this example, the equations below hold true as long as left-right loudspeaker—listener symmetry is maintained pairwise, that is, loudspeakers $S_3^0$ and $S_4^0$ are symmetric with respect to 0°, but there are no constraints on the pairs $S_1^0$, $S_3^0$, or $S_2^0$, $S_4^0$ as to symmetry. The actual speakers $S_1$ and $S_2$ are also assumed to be symmetrically arrayed with respect to the listener and the 0° line.

The example will be formulated as a parallel-type reformatter with $Y_0=I$. The acoustic matrix $X_0$ can written as $$X_0 = \begin{bmatrix} X_{1,1} & X_{1,2} & X_{1,3} & X_{1,4} \\ X_{2,1} & X_{2,2} & X_{2,3} & X_{2,4} \end{bmatrix}$$

The symmetry of the layout implies the following:

$X_{1,1}=X_{2,2}=S_0$ $X_{1,3}=X_{2,4}=T_0$ $X_{1,2}=X_{2,1}=A_0$ $X_{1,1}=X_{2,3}=B_0$ showing that there are only four unique filters among the eight required for this matrix. The matrix can be rewritten with the reduced number of filters as $$X_0 = \begin{bmatrix} S_0 & A_0 & T_0 & B_0 \\ A_0 & S_0 & B_0 & T_0 \end{bmatrix}$$

The symmetry on the right-hand side of FIG. 1 implies that $$X = \begin{bmatrix} S & A \\ A & S \end{bmatrix}$$

As described earlier for the parallel-type reformatter, the general equations to be solved are $XY=X_0Y_0$ with a solution of $Y=X^+X_0Y_0.$ For the example, with $Y_0=I$ and the pseudoinverse being the same as the inverse, $X^+=X^{-1}$, the equations to be solved are somewhat less complex and are $Y=X^{-1}X_0.$ It is easy to show that $$X^{-1} = \frac{1}{S^2-A^2}\begin{pmatrix} S & -A \\ -A & S \end{pmatrix}$$

which is the lattice version of the 2×2 crosstalk canceler discussed by Cooper and Bauck in their earlier patents. Direct calculation of Y using this expression results in the eight-filter expression as follows:

$$Y = \frac{1}{S^2-A^2}\begin{bmatrix} -AA_0+SS_0 & -AS_0+SS_0 & -AB_0+ST_0 & -AT_0+B_0S \\ -AS_0+A_0S & -AA_0+SS_0 & -AT_0+B_0S & -AB_0ST_0 \end{bmatrix}$$

This style of solution and implementation demonstrate the utility of the invention.

It is also a feature of the invention to implement solutions to the transaural equations in any and all factored forms which favorably affect the cost and/or complexity of implementation. Matrix factorizations are well-known in the mathematical arts, but their application to stereo theory is novel, especially with respect to economic considerations. The example will be continued to illustrate favorable factorizations. (Note that a matrix may often be factored in several different ways.) It should be noted that many cases in which a favorable factorization is found result from symmetric patterns of matrix elements which in turn result from symmetric loudspeaker-listener layouts. In the example, as above, there is $$X_0 = \begin{bmatrix} X_0 & A_0 & T_0 & B_0 \\ A_0 & S_0 & B_0 & T_0 \end{bmatrix}$$

and $$X = \begin{bmatrix} S & A \\ A & S \end{bmatrix}$$

wherein the matrix elements are not "random," but have a pattern. It is easy to show that $$X^{-1} = \frac{1}{2}\begin{bmatrix} 1 & 1 \\ 1 & -1 \end{bmatrix}\begin{bmatrix} \frac{1}{S+A} & 0 \\ 0 & \frac{1}{S-A} \end{bmatrix}\begin{bmatrix} 1 & 1 \\ 1 & -1 \end{bmatrix}$$

which is the shuffler version of the 2×2 crosstalk canceller taught by Cooper and Bauck.

Favorable factoring of $X_0$ is possible as well, especially if one notices that it contains two submatrices with the same general form as X, that is, there lies imbedded within it two 2×2 matrices each of which has common diagonal terms and common antidiagonal terms. While this kind of submatrix commonality will be found to be common in transaural equations with various amounts of symmetry, it will also be found that the symmetric matrix "subparts" may not be contiguous but more intertwined with one another, requiring a bit more skill by the designer to notice them. Sometimes this intertwining can be removed simply by renumbering the loudspeakers, for example. (In the present example, $X_0$ can become intertwined if the labels on loudspeakers $S_3^0$ and $S_4^0$ are switched with one another.)

Proceeding with factoring $X_0$, it is helpful to define $$P_4 = \begin{bmatrix} 1 & 1 & 0 & 0 \\ 1 & -1 & 0 & 0 \\ 0 & 0 & 1 & 1 \\ 0 & 0 & 1 & -1 \end{bmatrix}$$

and $$P_2 = \begin{bmatrix} 1 & 1 \\ 1 & -1 \end{bmatrix}$$

and to note that $P_2$ and $P_4$ are their own inverses, except for a constant scale factor of ½. As a conceptual aid in factoring, define $$X_1 = \frac{1}{2} P_2 X_0 P_4$$

resulting in $$X_1 = \frac{1}{2}\begin{bmatrix} 1 & 1 \\ 1 & -1 \end{bmatrix}\begin{bmatrix} S_0 & A_0 & T_0 & B_0 \\ A_0 & S_0 & B_0 & T_0 \end{bmatrix}\begin{bmatrix} 1 & 1 & 0 & 0 \\ 1 & -1 & 0 & 0 \\ 0 & 0 & 1 & 1 \\ 0 & 0 & 1 & -1 \end{bmatrix}$$

$$X_1 = \frac{1}{2}\begin{bmatrix} 1 & 1 \\ 1 & -1 \end{bmatrix}\begin{bmatrix} A_0 + S_0 & -A_0 + S_0 & B_0 + T_0 & -B_0 + T_0 \\ A_0 + S_0 & A_0 - S_0 & B_0 + T_0 & B_0 - T_0 \end{bmatrix}$$

$$X_1 = \begin{bmatrix} S_0 + A_0 & 0 & T_0 + B_0 & 0 \\ 0 & S_0 - A_0 & 0 & T_0 - B_0 \end{bmatrix}$$

Multiplying the defining equation for $X_1$ by $P_4$ on the right and by $P_2$ on the left results on $$X_0 = \frac{1}{2} P_2 X_1 P_4.$$

This is a highly favorable factorization of $X_0$—the matrices $P_2$ and $P_4$ are composed of only 1s, −1s, and 0s, all free or nearly free of implementation cost. Furthermore, the center matrix, $X_1$, which contains the frequency-dependent filters, has only four of eight entries which are non-zero, a savings in cost of four filters. (Nonetheless, in some applications the filters required for a factored-form matrix may actually be more complex than the filters which are required for another factored form, or the unfactored form, so that the designer needs to balance these possibilities as tradeoffs.)

The conceptual aid of defining the matrix $X_1$ as done here is not necessary and the factorization could have been found in many other ways, but the inventor has found this to be a useful device. Those practiced in the art of linear algebra and related arts may well find other devices useful, and indeed may find other useful factorizations.

In this example and in others, the factored forms of $X_0$ and $X^{-1}$, when their corresponding implementations are cascaded as indicated by the solution $X^{-1}X_0$, result in even further implementation savings. Note that $X^{-1}$ can be expressed using $P_2$ as $$X^{-1} = \frac{1}{2} P_2 \begin{bmatrix} \frac{1}{S+A} & 0 \\ 0 & \frac{1}{S-A} \end{bmatrix} P_2$$

so that $$Y = X^{-1} X_0 = \frac{1}{2} P_2 \begin{bmatrix} \frac{1}{S+A} & 0 \\ 0 & \frac{1}{S-A} \end{bmatrix} P_2 P_2 X_1 P_4.$$

Using the aforementioned property of $P_2$ that it is its own inverse except for a scale factor allows the expression to be further simplified as $$Y = X^{-1} X_0 = \frac{1}{2} P_2 \begin{bmatrix} \frac{1}{S+A} & 0 \\ 0 & \frac{1}{S-A} \end{bmatrix} X_1 P_4$$

that is, there is no need to implement the cascade $P_2P_2$, since the net effect is simply a constant gain factor of 2.

Using the above example as a basis, two other examples will be briefly described. First, imagine that the symmetry is present only in the actual acoustic matrix X but not the desired acoustic matrix $X_0$. This situation could arise, for example, in a virtual reality game wherein there are several distinct sound sources to be simulated and a player may (well) move out of the symmetric position. Another example is where a virtual theater is being simulated and it is desired to apparently rotate the entire theater around the listener's head, in the actual playback space (also with video game applications). In this example, the symmetry is generally lost in $X_0$ and so a factored form may not be available, requiring the "full-blown" version shown above as $$X_0 = \begin{bmatrix} X_{1,1} & X_{1,2} & X_{1,3} & X_{1,4} \\ X_{2,1} & X_{2,2} & X_{2,3} & X_{2,4} \end{bmatrix}.$$

However, if the actual listener (ears $E_1$ and $E_2$) remain in their symmetric position, then $X^{-1}$ may be implemented in its factored form.

In the other example using the first example as a basis, the symmetry may persist in $X_0$ but the listener may be seated in an off-center position, causing a loss of symmetry in X and consequently in $X^{-1}$. In this example, $X_0$ may be implemented in a factored form, but not $X^{-1}$, requiring instead a full, nonsymmetric 2×2 matrix implementation.

Figure 9A:
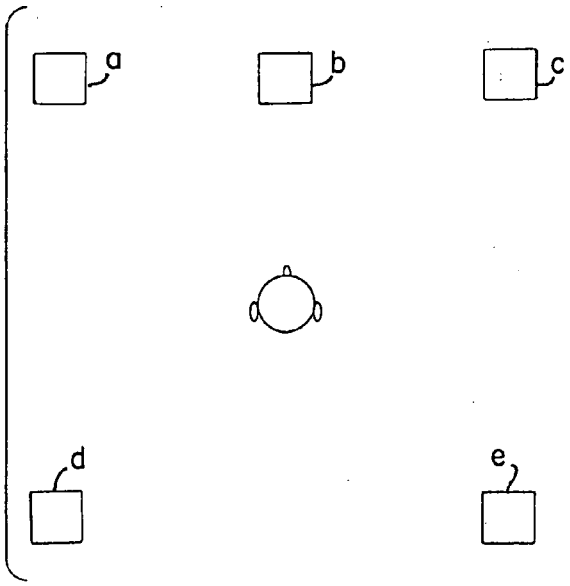
Figure 9B:
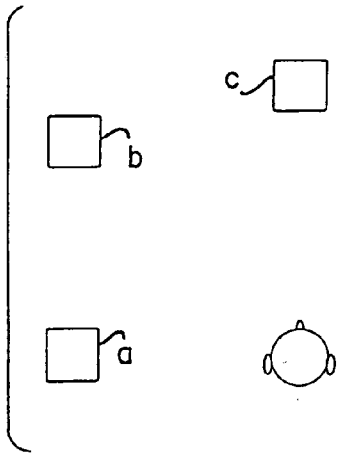
Figure 9C:
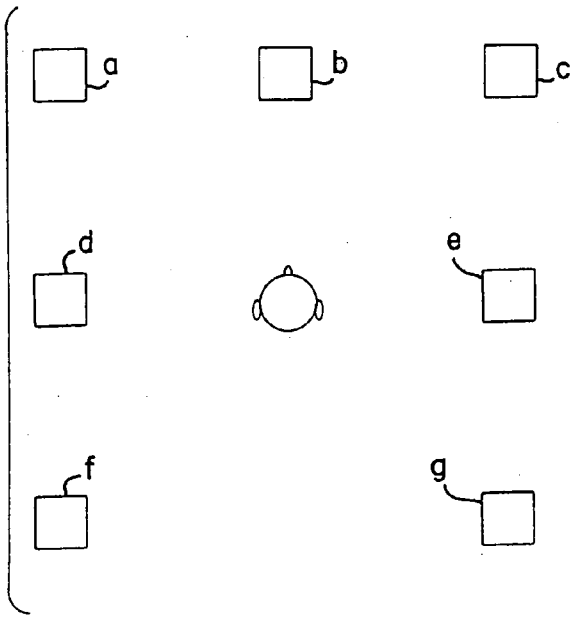
Figure 9D:
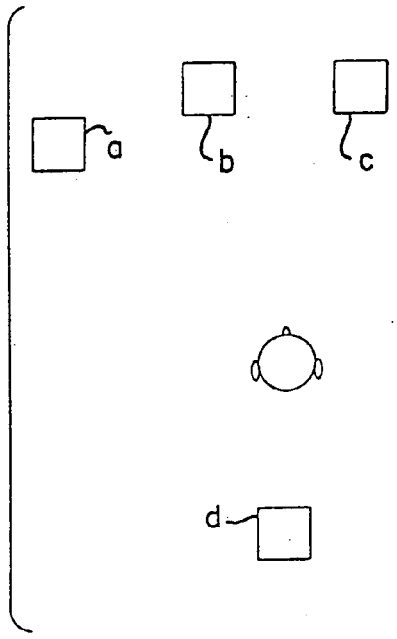

While the above examples provide a framework for the use of reformatter 10, the concept of reformatting has broad application. For example high-definition television (HDTV) or digital video disk (DVD) having multi-channel capability are easily provided. For a standard layout (including speaker positioning as shown in FIG. 9*a*), a number of non-standard speaker layouts (FIGS. 9*b*–9*h*) may be accommodated without loss of auditory imaging. Although elevational information has not been mentioned explicitly with regard to the various head-related transfer functions, it can be easily incorporated as suggested by FIG. 9*h*.

In another embodiment of the invention, the layout reformatter may have its filters changed over time, or in real time, according to any specification. Such specification may be for the purpose of varying or adjusting the imaging of the system in any way.

Any known method of changing the filters is contemplated, including reading filter parameters from look-up tables of previously computed filter parameters, interpolations from such tables, or real-time calculations of such parameters.

As suggested above, the solution of the transaural equations relies on the pseudoinverse when an exact solution is not available. The pseudoinverse, based on the well-known and popular Euclidean norm (2-norm) of vectors, results in approximations which are optimum with respect to this norm, that is, they are least-squares approximations. It is a feature of the invention that other approximations using other norms such as the 1-norm and the ∞-norm may also be used. Other, yet to be determined norms which better approximate the human psychoacoustic experience may be coupled to the method provided herein to give better approximations.

In situations where there is more than one solution to the transaural equations, there is usually an infinite number of solutions, and the pseudoinverse (or other approximation method) selects one which is optimum by some mathematical criterion. It is a feature of the invention that a designer, especially one who is experienced in audio system design, may find other solutions which are better by some other criterion. Alternatively, the designer may constrain the solution first, before applying the mathematical machinery. This was done in the three-loudspeaker reformatter described in detail, above, where the solution was constrained by requiring that the side speakers receive only filtered versions of the Left+Right and Left−Right signals. The pseudoinverse solution, without this constraint, would differ from the one given.

Layout reformatters will normally contain a crosstalk canceller, represented mathematically by the symbol $X^{-1}$ or $X^{+}$. An example of this symbolic usage is in the parallel-type reformatter described above where $Y=X^{+}X_0Y_0$. Layout reformatters will normally also contain other terms, such as $X_0Y_0$. It is a feature of the invention that these terms may be implemented either as separate functional blocks or combined into a single functional block the latter approach may be most economical if the desired and available layouts remain fixed. The former approach may be most economical if it is expected that one or both of the matrices may change over time, such as during game play or during the manufacture of computers with various monitors and correspondingly various acoustics.

It is a feature of the invention that the series reformatter be used as a channel reformatter for broadcast or storage applications wherein there are more than two channels in the desired space, $N_0 \geqq 2$, and only $L_0 \geqq 2$ (say) channels available for transmission or storage. (Although such channel limitations appear to be alleviated with the advent of high-density storage media and broadband digital transmission-channels, the use of real-time audio on the Internet presents a challenge.)

It is a feature of the invention that any or all of the transfer functions of Y may be modified in their implementation such that they are smoothed in the magnitude and/or phase responses relative to a fully accurate rendition.

It is a further feature that any or all of the transfer functions comprising Y may be converted to their minimum phase form. Although both of these modifications represent deviations, possibly significant or even detrimental perceptually, compared to an exact solution to the equation, they are highly practical and in some cases may represent the only practical and/or economical designs.

It is a further feature of the invention that such smoothing may be implemented in any manner whatsoever, including truncation or other shortening or effective shortening of a filter's impulse response (such shortening smooths the transfer function, as taught by the Fourier uncertainty principle), whether of finite (FIR) or infinite (IIR) type, smoothing with a convolution kernel in the frequency domain including so-called critical band smoothing, ad hoc decisions by the designer, or serendipitous artifacts caused by reducing the complexity of the filters, and for any purpose, such as to enlarge the sweet spot, to simplify the structure of the filter, or to reduce its cost.

The transfer functions of Y may be further modified in a manner analogous to that described by Kevin Kotorinsky ("Digital Binaural/Stereo Conversion and Crosstalk Cancelling," preprint number 2949 of the Audio Engineering Society). Kotorinsky showed that head-related transfer functions are nonminimum phase for at least some directions of arrival, including frontal directions commonly used for loudspeaker placement. The resulting filters of Y for the simple 2×2 crosstalk canceller, and likely more sophisticated devices according to the invention, are therefore unstable, meaning that their output signals grow without bound (in the linear model) under the influence of most input signals.

Kotorinsky showed, for a 2×2 crosstalk canceller, a method of multiplying the filters of the crosstalk canceller by a stable all-pass function which results in stable filters and which maintain full depth of cancellation at all frequencies (in principle, and smoothing notwithstanding). That this method of phase EQ is acceptable perceptually is the result of the human ear's well-known insensitivity to many types of phase alterations, said insensitivity sometimes-referred to as Ohm's Second Law of Acoustics. This method of phase EQ may be preferable to the use of minimum phase functions which normally result in loss of cancellation (in this case) or generally in loss of control over the desired ear signals, in certain frequency regions.

In addition to the nonminimum phase nature of at least some head-related transfer functions, other sources of Y filter instability may result from other physical sources and/or the particular mathematical formulation of a layout reformatter problem.

It is a feature of the invention to deal with these instabilities by using minimum phase transfer functions or by using Kotorinsky-style phase equalization or both in combination.

The above description formulates the general stereo model, and thus the transaural model and layout reformatter model, in terms of matrices of frequency-domain signals and (frequency-domain) transfer functions. While this is probably the most common formulation of problems involving linear systems, other formulations of linear systems are possible. Examples include the state space model, various time-domain models resulting in time-domain least-squares approximations, and models which use adaptive filters as elements of Y either during the design or use of the invention.

It is a feature of the invention that any model and/or design procedure which captures the salient properties of the various layouts and the manner in which signals, be they electronic, digital, or acoustic, propagate between and among the components of the layouts, may be used by the system designer.

Specific embodiments of a novel method for reformatting acoustic signals according to the present invention have been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention any and all modifications, variations, or equivalents that fall within the true spirit and scope of the basic underlying principles disclosed and claimed herein.

The invention claimed is:

1. A method of substantially recreating a spatial acoustic perception of a first listener of a first loudspeaker-listener layout for a plurality of listeners of a second loudspeaker-listener layout whereby the perception of the first listener of the first loudspeaker-listener layout is caused by an excitation signal being applied through a first matrix transfer function to a loudspeakers of the first loudspeaker-listener layout, the method comprising the steps of:

determining a second matrix of transfer functions from the loudspeakers of the first loudspeaker-listener layout to the ears of the first listener of the first loudspeaker-listener layout;

determining a third matrix of transfer functions from a plurality of loudspeakers of the second loudspeaker-listener layout to the ears of the plurality of listeners of the second loudspeaker-listener layout;

determining a fourth matrix of transfer functions from the first, second, and third matrices which substantially recreates the spatial acoustic perception of the first listener of the first loudspeaker-listener layout for the plurality of listeners of the second loudspeaker-listener layout; and applying the excitation signal to an electronic implementation of the fourth matrix and in turn to the plurality of loudspeakers of the second loudspeaker-listener layout, for the benefit of the plurality of listeners in the second loudspeaker-listener layout, wherein at least some of the elemental transfer functions of the second, third, and fourth matrices of transfer functions are derived from model head-related transfer functions, and wherein the plurality of listeners of the second loudspeaker-listener layout all listen simultaneously.

2. A method of substantially recreating a spatial acoustic perception of a first listener of a first loudspeaker-listener layout for a plurality of listeners of a second loudspeaker-listener layout whereby the perception of the first listener of the first loudspeaker-listener layout is caused by one or more excitation signals being applied through a first matrix of transfer functions to a plurality of loudspeakers of the first loudspeaker-listener layout, the method comprising the steps of:

determining a second matrix of transfer functions from the plurality of loudspeakers of the first loudspeaker-listener layout to the ears of the first listener of the first loudspeaker-listener layout;

determining a third matrix of transfer functions from the plurality of loudspeakers of the second loudspeaker-listener layout to the ears of the plurality of listeners of the second loudspeaker-listener layout;

determining a fourth matrix of transfer functions from the first, second, and third matrices which substantially recreates the spatial acoustic perception of the first listener of the first loudspeaker-listener layout for the plurality of listeners of the second loudspeaker-listener layout; and applying the one or more excitation signals to an electronic implementation of the fourth matrix and in turn to the plurality of loudspeakers of the second loudspeaker-listener layout, for the benefit of the plurality of listeners in the second loudspeaker-listener layout, wherein at least some of the elemental transfer functions of the second, third, and fourth matrices of transfer functions are derived from model head-related transfer functions, wherein the number and relative positions of the loudspeakers of the first loudspeaker-listener layout and the number and relative positions of the loudspeakers second loudspeaker-listener layout are the same, and wherein the plurality of listeners of the second loudspeaker-listener layout all listen simultaneously.

3. A method of substantially recreating a spatial acoustic perception of a first listener of a first loudspeaker-listener layout for a plurality of listeners of a second loudspeaker-listener layout whereby the perception of the first listener of the first loudspeaker-listener layout is caused by one or more excitation signals being applied through a first matrix of transfer functions to one or more loudspeakers of the first loudspeaker-listener layout, the method comprising the steps of:

determining a second matrix of transfer functions from the one or more loudspeakers of the first loudspeaker-listener layout to the ears of the first listener of the first loudspeaker-listener layout;

determining a third matrix of transfer functions from a plurality of loudspeakers of the second loudspeaker-listener layout to the ears of the plurality of listeners of the second loudspeaker-listener layout;

determining a fourth matrix of transfer functions from the first, second, and third matrices which substantially recreates the spatial acoustic perception of the first listener of the first loudspeaker-listener layout for the plurality of listeners of the second loudspeaker-listener layout; and applying the one or more excitation signals to an electronic implementation of the fourth matrix and in turn to the plurality of loudspeakers of the second loudspeaker-listener layout, for the benefit of the plurality of listeners in the second loudspeaker-listener layout, wherein at least some of the elemental transfer functions of the second, third, and fourth matrices of transfer functions are derived from model head-related transfer functions, and wherein the plurality of listeners of the second loudspeaker-listener layout all listen simultaneously.

4. A method of substantially recreating a spatial acoustic perception of a first listener of a first loudspeaker-listener layout for a second listener of a second loudspeaker-listener layout whereby the perception of the first listener of the first loudspeaker-listener layout is caused by one or more excitation signals being applied through a first matrix of transfer functions to one or more loudspeakers of the first loudspeaker-listener layout, the method comprising the steps of:

determining a second matrix of transfer functions from the one or more loudspeakers of the first loudspeaker-listener layout to the ears of the first listener of the first loudspeaker-listener layout;

determining a third matrix of transfer functions from more than four loudspeakers of the second loudspeaker-listener layout to the ears of the second listener of the second loudspeaker-listener layout;

determining a fourth matrix of transfer functions from the first, second, and third matrices which substantially recreates the spatial acoustic perception of the first listener of the first loudspeaker-listener layout for the second listener of the second loudspeaker-listener layout; and applying the one or more excitation signals to an electronic implementation of the fourth matrix and in turn to the more than four loudspeakers of the second loudspeaker-listener layout, for the benefit of the second listener of the second loudspeaker-listener layout, wherein at least some of the elemental transfer functions of the second, third, and fourth matrices of transfer functions are derived from model head-related transfer functions and the first and second loudspeaker-listener layout are different.

5. A method of substantially recreating one or more spatial acoustic perceptions of a plurality of listeners of a first loudspeaker-listener layout for a plurality of listeners of a second loudspeaker-listener layout whereby the one or more perceptions of the plurality of listeners of the first loudspeaker-listener layout is caused by one or more excitation signals being applied through a first matrix of transfer functions to one or more loudspeakers of the first loudspeaker-listener layout, the method comprising the steps of:

determining a second matrix of transfer functions from the one or more loudspeakers of the first loudspeaker-listener layout to the ears of the plurality of listeners of the first loudspeaker-listener layout;

determining a third matrix of transfer functions from a plurality of loudspeakers of the second loudspeaker-listener layout to the ears of the plurality of listeners of the second loudspeaker-listener layout;

determining a fourth matrix of transfer functions from the first, second, and third matrices which substantially recreates the one or more spatial acoustic perceptions of the plurality of listeners of the first loudspeaker-listener layout for the plurality of listeners of the second loudspeaker-listener layout; and applying the one or more excitation signals to an electronic implementation of the fourth matrix and in turn to the plurality of loudspeakers of the second loudspeaker-listener layout, for the benefit of the plurality of listeners of the second loudspeaker-listener layout, wherein at least some of the elemental transfer functions of the second, third, and fourth matrices of transfer functions are derived from model head-related transfer functions, and wherein the plurality of listeners of the second loudspeaker-listener layout all listen simultaneously.

6. A method of substantially recreating an acoustic perception of a first listener of a first loudspeaker-listener layout for a plurality of listeners of a second loudspeaker-listener layout whereby the perception of the first listener of the first loudspeaker-listener layout is caused by one or more excitation signals being applied through a first matrix of transfer functions to one or more loudspeakers of the first loudspeaker-listener layout, the method comprising the steps of:

determining a second matrix of transfer functions from the one or more loudspeakers of the first loudspeaker-listener layout to the ears of the first listener of the first loudspeaker-listener layout;

determining a third matrix of transfer functions from three or more loudspeakers of the second loudspeaker-listener layout to the ears of the plurality of listeners of the second loudspeaker-listener layout;

determining a fourth matrix of transfer functions from the first, second, and third matrices which substantially recreates the spatial acoustic perception of the first listener of the first loudspeaker-listener layout for the plurality of listeners of the second loudspeaker-listener layout; and applying the one or more excitation signals to an electronic implementation of the fourth matrix and in turn to the three or more loudspeakers of the second loudspeaker-listener layout, for the benefit of the plurality of listeners of the second loudspeaker-listener layout, wherein at least some of the elemental transfer functions of the second, third, and fourth matrices of transfer functions are derived from model head-related transfer functions, and wherein the plurality of listeners of the second loudspeaker-listener layout all listen simultaneously.

* * * * *